US011648653B2

(12) United States Patent
Baba

(10) Patent No.: US 11,648,653 B2
(45) Date of Patent: May 16, 2023

(54) DRIVING TOOL

(71) Applicant: MAKITA CORPORATION, Anjo (JP)

(72) Inventor: Norikazu Baba, Anjo (JP)

(73) Assignee: MAKITA CORPORATION, Anjo (JP)

( * ) Notice: Subject to any disclaimer, the term of this patent is extended or adjusted under 35 U.S.C. 154(b) by 233 days.

(21) Appl. No.: 17/160,513

(22) Filed: Jan. 28, 2021

(65) Prior Publication Data

US 2021/0299836 A1 Sep. 30, 2021

(30) Foreign Application Priority Data

Mar. 31, 2020 (JP) ..... JP2020-063846

(51) Int. Cl.
*B25C 1/04* (2006.01)
*B25C 5/13* (2006.01)

(52) U.S. Cl.
CPC ..... *B25C 1/047* (2013.01); *B25C 5/13* (2013.01)

(58) Field of Classification Search
CPC .. B25C 1/047; B25C 5/13; B25C 1/06; B25C 1/04
See application file for complete search history.

(56) References Cited

U.S. PATENT DOCUMENTS 3,589,588 A * 6/1971 Vasku ..... B25C 1/06 227/132
4,042,036 A * 8/1977 Smith ..... B25C 1/06 74/125.5
4,971,238 A * 11/1990 Furutsu ..... B65C 7/006 173/205
5,388,749 A * 2/1995 Davignon ..... B65C 7/006 227/67
7,334,715 B2 * 2/2008 Oda ..... B25C 1/06 173/205
8,011,441 B2 * 9/2011 Leimbach ..... B25C 1/041 227/129
8,875,969 B2 * 11/2014 Pedicini ..... B25C 1/04 227/8
10,632,601 B2 * 4/2020 Pomeroy ..... B25C 1/04
10,730,172 B2 * 8/2020 Po ..... B25C 1/047
10,821,586 B2 * 11/2020 Wu ..... B25C 1/047
10,843,317 B2 * 11/2020 Sato ..... B25C 7/00
10,898,994 B2 * 1/2021 Carrier ..... B25C 1/04
11,130,221 B2 * 9/2021 Mikat-Stevens ..... B25C 5/1637
11,185,971 B2 * 11/2021 Carrier ..... B25C 1/047
(Continued)

FOREIGN PATENT DOCUMENTS

JP 6260944 B2 1/2018

*Primary Examiner* — Thomas M Wittenschlaeger
*Assistant Examiner* — Katie L Gerth
(74) *Attorney, Agent, or Firm* — Oliff PLC

(57) ABSTRACT

When a driving piston starts moving upward toward its top dead center or starts moving downward, a second engaging portion engageable with a second rack of a driver is configured to receive a force. The second engaging portion of a second wheel is provided with high strength and wear resistance. Because of this configuration, a cost of production and maintenance replacement parts can be reduced, in comparison with a case where a total mechanism, including first engaging portions of a first wheel, is provided with high strength and wear resistance.

17 Claims, 18 Drawing Sheets

(56) References Cited

U.S. PATENT DOCUMENTS

| | | | | |
|---|---|---|---|---|
| 11,331,781 | B2 * | 5/2022 | Bierdeman | B25C 1/047 |
| 11,345,008 | B2 * | 5/2022 | Pomeroy | B25C 1/008 |
| 11,446,801 | B2 * | 9/2022 | Aizawa | B25C 1/06 |
| 2005/0082334 | A1 * | 4/2005 | Hu | B25C 1/06 227/132 |
| 2007/0210134 | A1 * | 9/2007 | Oda | B25C 1/06 227/131 |
| 2011/0198381 | A1 * | 8/2011 | McCardle | B25C 1/047 227/8 |
| 2014/0202724 | A1 * | 7/2014 | Moore | B25C 1/047 173/46 |
| 2016/0096259 | A1 * | 4/2016 | Pedicini | B25C 1/047 227/146 |
| 2016/0288305 | A1 * | 10/2016 | McCardle | B25C 1/047 |
| 2017/0190037 | A1 * | 7/2017 | Sato | B25C 1/06 |
| 2018/0126527 | A1 * | 5/2018 | Pomeroy | B25C 1/06 |
| 2018/0126528 | A1 * | 5/2018 | Pomeroy | B25C 1/06 |
| 2018/0133877 | A1 * | 5/2018 | Ueda | B25F 5/006 |
| 2018/0154505 | A1 * | 6/2018 | Sato | B25C 1/047 |
| 2019/0168366 | A1 * | 6/2019 | Yasutomi | B25C 1/047 |
| 2019/0321955 | A1 * | 10/2019 | Carrier | B25C 1/047 |
| 2020/0114500 | A1 * | 4/2020 | Bierdeman | B25C 1/04 |

* cited by examiner 10
3a
3
4
11
13b
13a
13a(13)
12
12a
32
32a
33
33a
34
35
6
n
W 10
3a
3
4
11
13b
(13)
13a
12
(12a)
41a
41
45
42
42a
44
13a (13)
6
n
W

DRIVING TOOL

CROSS-REFERENCE TO RELATED APPLICATIONS

This application claims priority to Japanese patent application serial number 2020-063846, filed on Mar. 31, 2020, the contents of which are incorporated herein by reference in its entirety.

BACKGROUND

The present disclosure generally relates to a driving tool for driving a material, such as a nail or a staple, into a workpiece such as, for example, a wooden material.

Driving tools, such as a gas-spring type driving tool and a mechanical-spring type driving tool, are well known. For instance, in Japanese Patent No. 6260944, a gas-spring type driving tool may include a driver for driving a driving material, a rack for moving the driver upward, and a wheel. The rack is provided in the driver and the driver is formed integral with a piston. When the wheel rotates, the rack, the driver and the piston move upward, thereby increasing the pressure of a gas in an accumulation chamber communicating with a cylinder. By utilizing the pressure of gas in the accumulation chamber, the piston and the driver moves downward, thereby causing the driving material to be driven by the driver.

The wheel includes a plurality of engaging portions, a roller adjacent to the engaging portions, and a region where there is no engaging portion in a circumferential direction of the wheel. During the time when the driver moves upward, the plurality of engaging portions engage the rack one after another and finally the roller engages the rack. When the wheel rotates further, the roller disengages from the rack. Because of the presence of a region where there is no engagement portion, the wheel allows the rack and the driver to move downward. By use of the roller, the wheel disengages from the rack with a small frictional resistance. Then, the driver moves downward smoothly due to the pressure of the gas in the accumulation chamber.

However, a larger force is applied to the last engaging portion engaged with the rack. i.e., the roller corresponding to the last engaging portion, in comparison with the other engaging portions. In more detail, when the driver and the rack are moved upward by the wheel, the pressure of gas in the accumulation chamber increases. Owing to this, a larger force is applied to the last engagement portion, i.e., the roller corresponding to the last engaging portion, in comparison with the other engagement portions. A mechanical-spring type driving tool works in a similar manner to a gas-spring type driving tool. In the mechanical-spring type driving tool, when the driver and the rack are moved upward by the wheel, an elastic energy stored by a spring, which provides the driver with a driving force, increases. Immediately before the wheel disengages from the rack, only the last engaging portion or the roller engages with the rack. Therefore, a large force is applied to the last engaging portion. Because of this, wear of the last engaging portion may be increased in comparison with the other engaging portions. Thus, there is a need to provide a mechanism for the driving tool in which the last engagement portion is less subject to wear.

SUMMARY

According to one feature of the present disclosure, a driving tool comprises a driver provided in a housing so as to be movable in an up-down direction, thereby driving a driving member. The driving tool also comprises a driving mechanism in which driving energy is stored by movement of the driver in an upward direction, a first rack and a second rack provided in the driver to move the driver in the upward direction, a first wheel including a plurality of first engaging portions engageable with the first rack, and a second wheel including one second engaging portion engageable with the second rack. Furthermore, the second engaging portion of the second wheel is disposed such that: (i) in a stage of an initial upward movement of the driver, the second engaging portion of the second wheel engages the second rack at a same time as or before the first engaging portion of the first wheel engages the first rack; and (ii) in a stage of a final upward movement of the driver, the second engaging portion of the second wheel disengages from the second rack at a same time as or after the first engaging portion of the first wheel disengages from the first rack.

Because of this configuration, by rotation of the first wheel and the second wheel, the driver returns upward. In the stage of the initial upward movement of the driver, when the first engaging portion of the first wheel engages the first rack, the second engaging portion of the second wheel engages the second rack. In more detail, in the stage of the initial upward movement of the driver, the second engaging portion engages the second rack at the same time or before the first engaging portion of the first wheel engages the first rack. When the driver reaches the top dead center, the second engaging portion of the second wheel engages the second rack (which may be in the stage of the final upward movement of the driver). In other words, the second engaging portion of the second wheel engages the second rack both in the stage of the initial upward movement and in the stage of the final upward movement. After the driver reaches the top dead center, the second engaging portion disengages from the second rack by further rotation of the second wheel. Furthermore, in the stage of the final upward movement of the driver, the second engaging portion of the second rack disengages from the second rack at the same time as or after the first engaging portion of the first wheel disengages from the first rack. Then, the driver drives the driving member by the driving mechanism. The second engaging portion of the second wheel has high durability and wear resistance. Because of this configuration, a cost of production can be reduced, in comparison with a case where a total mechanism, including the first engaging portions of the first wheel, is provided with high strength and wear resistance. Furthermore, as a degree of wear progresses, it may be sufficient to replace only the second wheel or only the second engaging portion of the second wheel. The original first wheel can continue to be used. As a result, a cost of maintenance can be reduced. Also, the second engaging portion of the second wheel may work as a common engaging portion for both starting and releasing the engagement with the second rack. In this respect, further cost reductions can be obtained.

According to another feature of the present disclosure, the first wheel is disposed on one lateral side of the driver and the second wheel is disposed on the other lateral side of the driver. Thus, both sides of the driver are engaged by the first wheel and the second wheel. As a result, the driver can be prevented from being displaced to one side when the driver moves upward.

According to another feature of the present disclosure, both the first wheel and the second wheel are disposed on one lateral side of the driver. Because of this, a driving nose from which the driving member is driven by the driver can be made more compact.

According to another feature of the present disclosure, the second engaging portion of the second wheel has a roller structure configured to rotate relative to the second rack. Because of this, high frictional resistance by the second engaging portion serving as the common engaging portion can be obtained.

According to another feature of the present disclosure, a ratio of rotation number of the second wheel to the first wheel is configured to be an integer. Because of this, a mechanism for moving the driver can be simple and reliable.

According to another feature of the present disclosure, a rotation speed of the second wheel is higher than that of the first wheel. Because of this, the second wheel can be compact while the second wheel cooperates with the first wheel.

According to another feature of the present disclosure, the second engaging portion of the second wheel has a higher strength than the first engaging portions of the first wheel. Because of this, the first engaging portions of the first wheel are allowed to have a weaker strength in durability and wear resistance than that of the second engaging portion of the second wheel. As a result, cost reduction can be obtained.

According to another feature of the present disclosure, an engaging tooth of the second rack engageable with the second engaging portion of the second wheel in the stage of the final upward movement of the driver has a higher strength than engaging teeth of the first rack engageable with the first engaging portions of the first wheel. Thus, a reduction in the total cost can be obtained by only increasing strength for the required portions.

DETAILED DESCRIPTION

The detailed description set forth below, when considered with the appended drawings, is intended to be a description of exemplary embodiments of the present invention and is not intended to be restrictive and/or to represent the only embodiments in which the present invention can be practiced. The term "exemplary" used throughout this description means "serving as an example, instance, or illustration," and should not necessarily be construed as preferred or advantageous over other exemplary embodiments. The detailed description includes specific details for the purpose of providing a thorough understanding of the exemplary embodiments of the invention. It will be apparent to those skilled in the art that the exemplary embodiments of the invention may be practiced without these specific details. In some instances, these specific details refer to well-known structures, components, and/or devices that are shown in block diagram form in order to avoid obscuring significant aspects of the exemplary embodiments presented herein.

Figure 1:
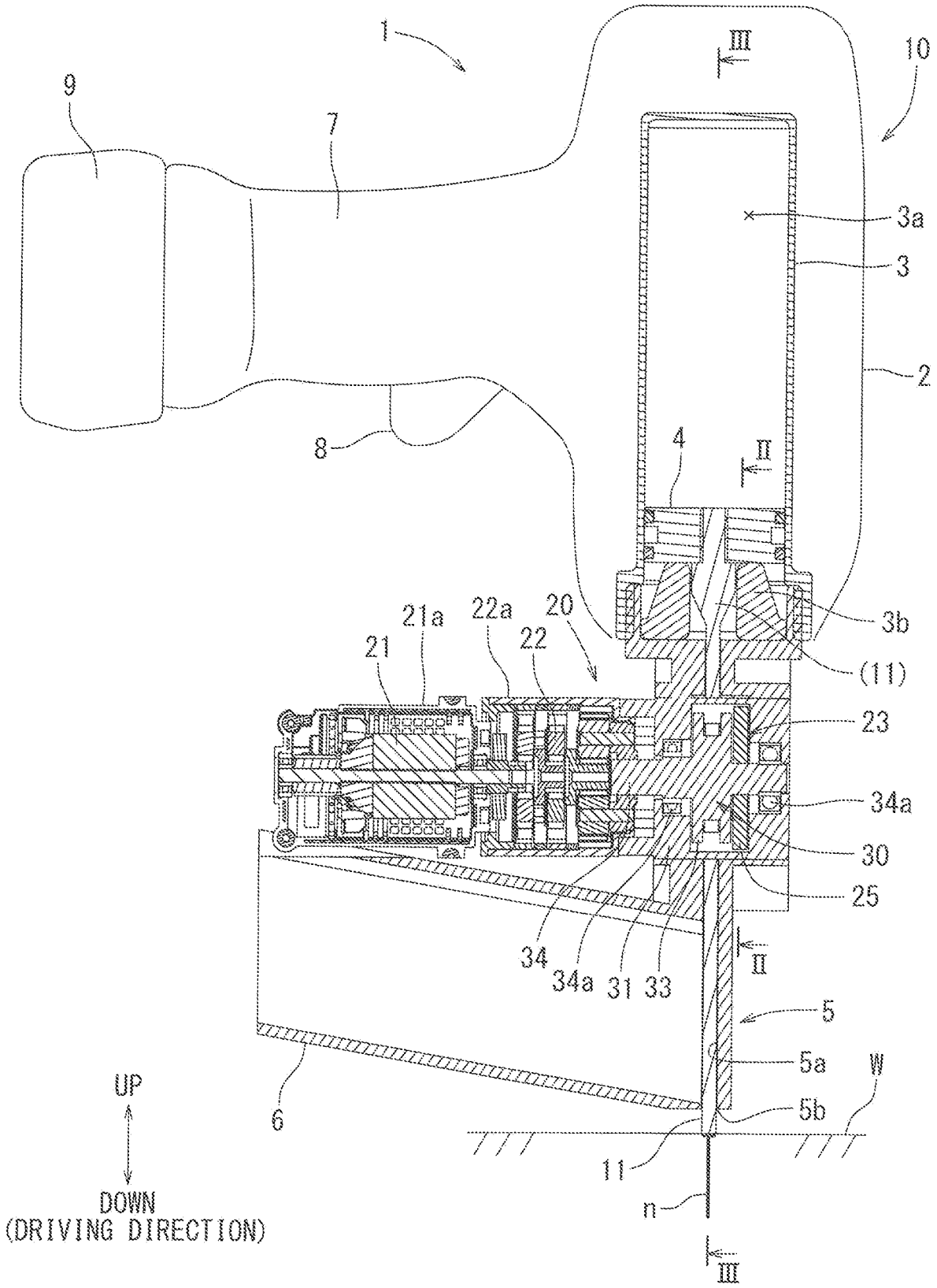
FIG. 1 is a longitudinal sectional view of a driving tool according to a first embodiment of the present disclosures, showing a state where a driving operation is performed.

A driving tool 1 according to a first embodiment to a third embodiment of the present disclosures will be described with reference to FIGS. 1 to 18. In the first embodiment to the third embodiment, a gas-spring type driving tool, which utilizes a pressure of a gas filled in an accumulation chamber as a driving force for driving a driving member n, will be exemplified as the driving tool 1. FIGS. 1 to 4 shows the driving tool 1 according to the first embodiment of the present disclosures. In the following explanation, a driving direction of the driving member is a downward direction, and a direction opposite to the driving direction is an upward direction. When a driver 11, which will be discussed later in detail, moves downward, the driving member n may be driven. After that, the driver 11 may move upward to be returned to its original position. In the following explanation, a direction perpendicular to a paper surface in FIG. 1 is referred to as a width direction of the driving tool 1.

Figure 2:
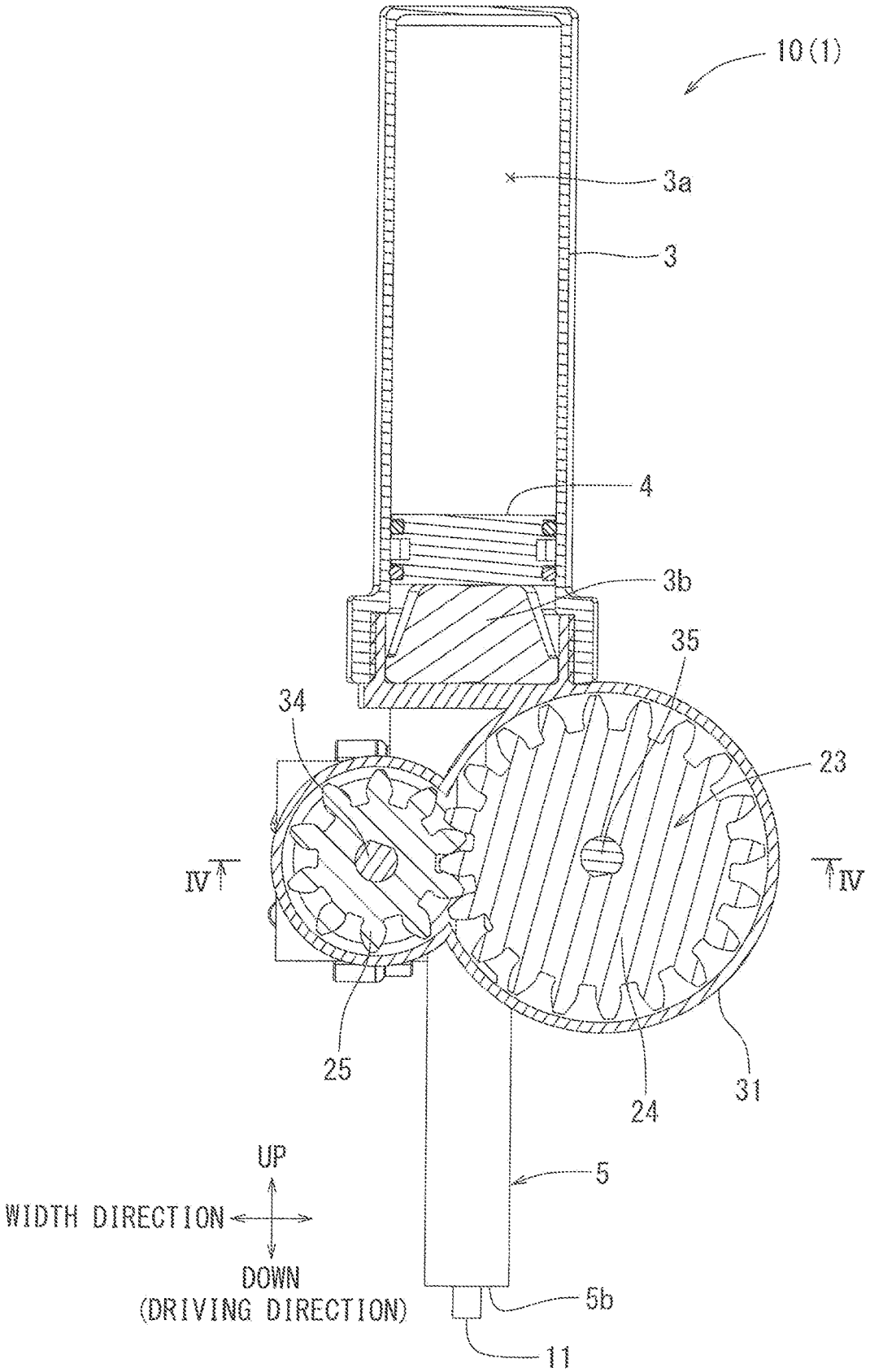
FIG. 2 is a cross-sectional view taken along line II-II of FIG. 1, showing a transversal cross-sectional view of a reduction gear.
Figure 3:
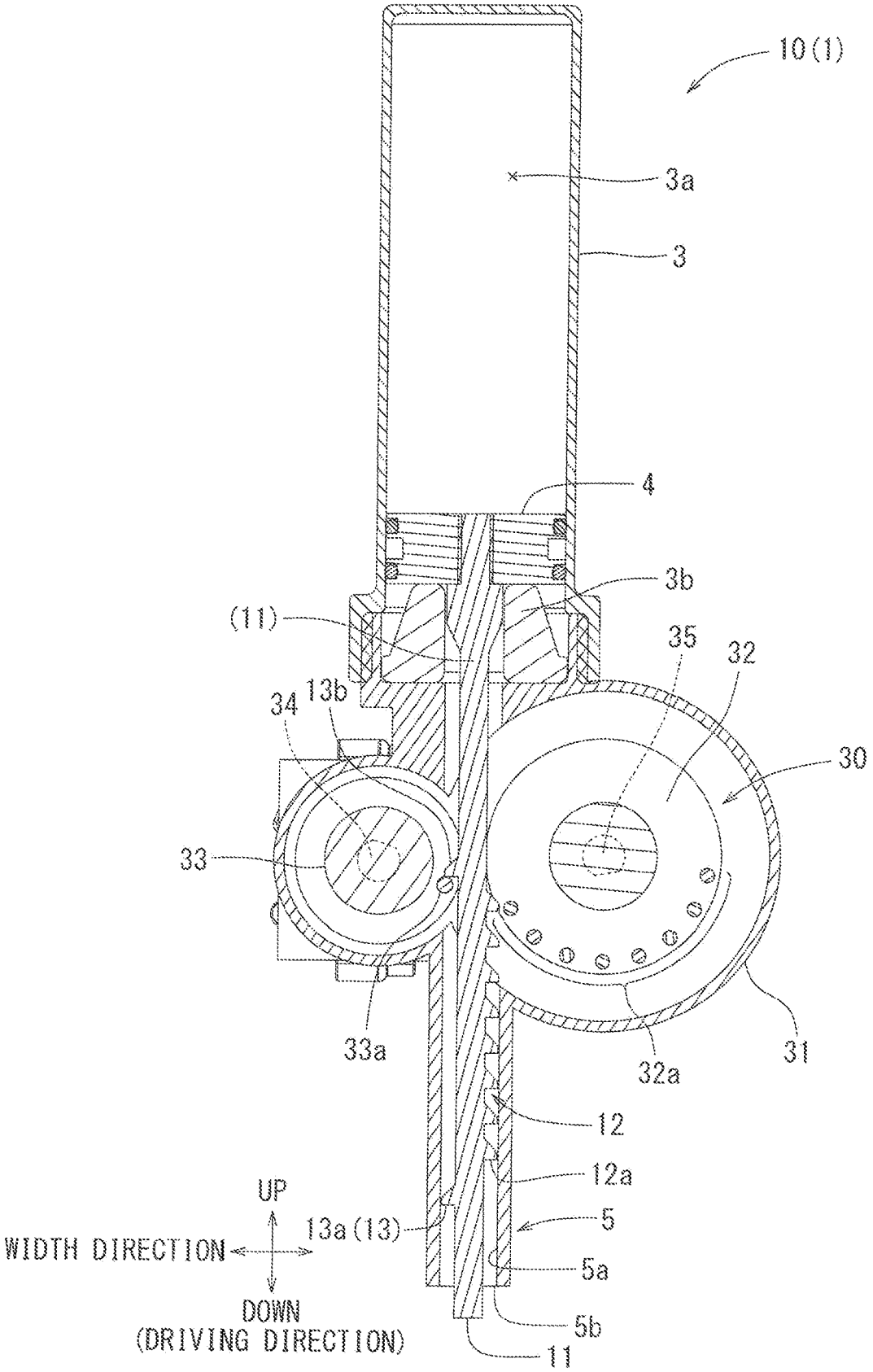
FIG. 3 is a cross-sectional view taken along line III-III of FIG. 1, showing a transversal cross-sectional view of a drive-returning mechanism.

The driving tool 1 of the first embodiment may include a tool main body 10. The tool main body 10 may house a cylinder 3 within a tubular main body housing 2. The cylinder 3 may support a driving piston 4 so that the driving piston 4 may reciprocate in an up-down direction. A driver 11 for driving a driving member n may be provided to extend downward from a center of a lower surface of the driving piston 4. The driving piston 4 and the driver 11 may be integrally provided, so that they may reciprocate within the cylinder 3 in the up-down direction. The driver 11 may extend long in the downward direction. A tip end of the driver 11 may enter a driving passage 5*a* of a driving nose 5 provided at a lower end of the tool main body 10. A lower end of the driving nose 5 may be an injection port 5*b*, from which the driving member n is driven out. FIGS. 1 to 3 show a state where the driving piston 4 moves to its movement lower end and the driving member n is driven out from the injection port 5*b*. Further, FIGS. 1 to 3 show that the driver 11 moves downward in the driving passage 5*a* and the tip end of the driver 11 may slightly protrude from the injection port 5*b*.

A magazine 6, which may be loaded with a plurality of driving members n, may be linked to the driving nozzle 5. A handle 7 for a user to hold may be provided on a lateral side of the main body housing 2. A switch lever 8 for the user to pull with a fingertip may be provided in a base portion of the handle 7. A battery pack 9 serving as a power source may be attached to an end of the handle 7. The battery pack 9 may be rechargeable and may be detached from the driving tool 1 in order to use it as a power source of another electric power device. The main body housing 2, the handle 7, the switch lever 8, and the battery pack 9 are shown in only FIG. 1 and are omitted in other figures.

The driving nose 5 may be provided with a driver-returning mechanism 20. The driver-returning mechanism 20 may be configured to return the driving piston 4 as well as the driver 11 upward to its original position. When the driving piston 4 returns upward by the driver-returning mechanism 20, the gas pressure in the accumulation chamber 3*a* disposed above the upper surface of the driving piston 4 may increase. The driving piston 4 may move downward owing to the increased gas pressure in the accumulation chamber 3*a*. As a result, the driver 11 may drive the driving member n. The driver-returning mechanism 20, may be an example of a driving mechanism of the driving tool 1. The driving mechanism of the driving tool 1 may have a configuration for storing a driving energy (e.g., a thrust power in the accumulation chamber 3*a*) obtained due to an upward movement of the driver 11. A damper 3*b* may be disposed at a lower end of the cylinder 3 in order to absorb an impact the driving piston 4 receives when the driving piston 4 moves toward its lowermost end.

The driver-returning mechanism 20 may include an electric motor 21, a reduction gear train 22, and a wheel mechanism 30. The electric motor 21 may be powered by the battery pack 9 serving as the electric power source. The electric motor 21 may be actuated by a pulling operation of the switch lever 8. A rotation output of the electric motor 21 may be reduced by the reduction gear train 22, which may comprise a planetary gear train arranged in two rows, and may be output to the wheel mechanism 30. The electric motor 21 may be housed in a tubular motor case 21*a*. Also, the reduction gear train 22 may be housed in a tubular gear case 22*a*. The tubular motor case 21*a* may be coaxially connected to an end portion of the gear case 22*a*.

Figure 5:
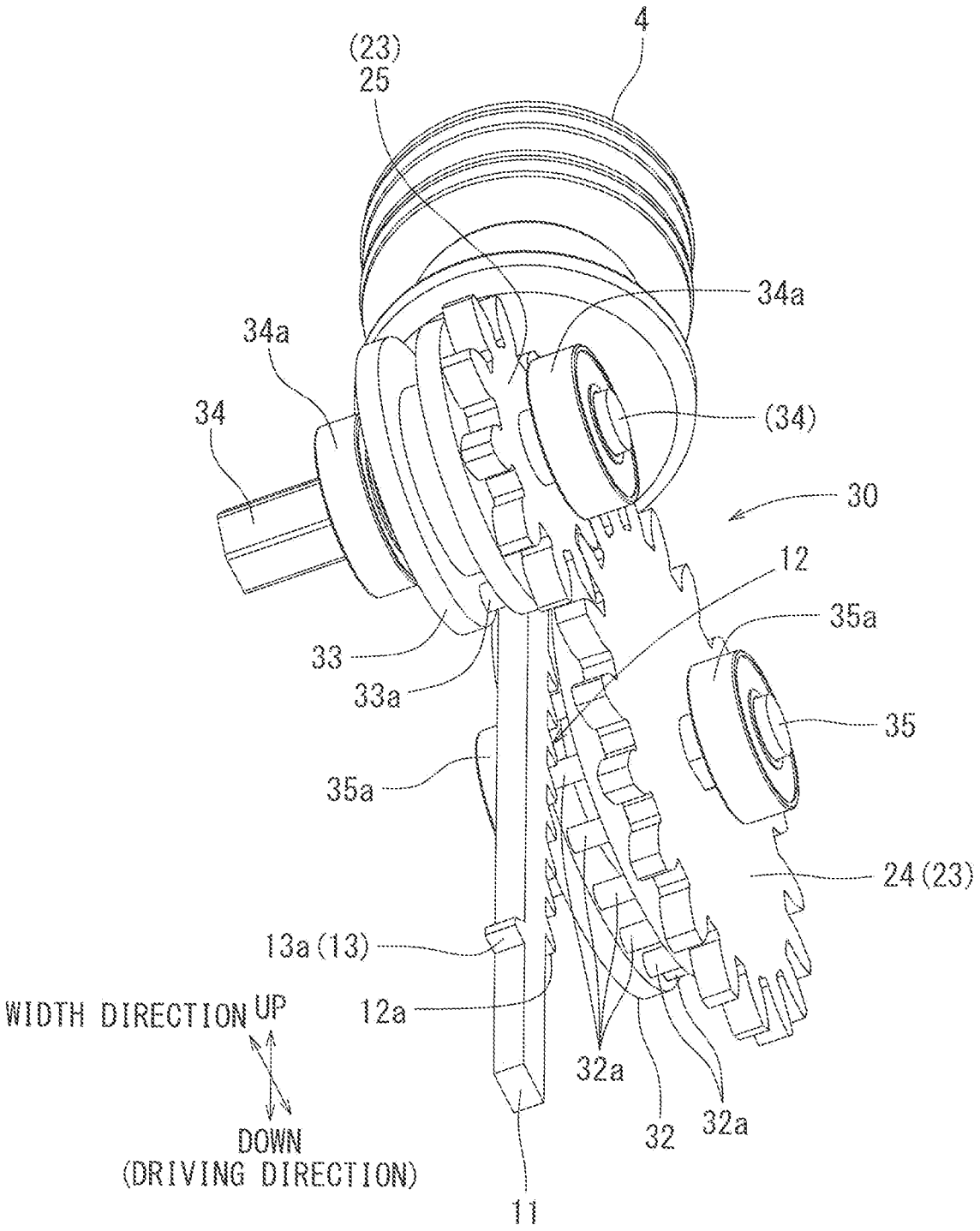
FIG. 5 is a perspective view of the driver-returning mechanism according to the first embodiment.

The wheel mechanism 30 may include a mechanism case 31. As shown in FIG. 2, a contour of the mechanism case 31 may form a shape of a numeral eight (8) in cross-section, in such a manner that a large circular tube combines with a small circular tube. The mechanism case 31 may be integrally provided with the driving nose 5. The mechanism case 31 may be linked to the gear case 22*a*. FIG. 5 shows a perspective view of the wheel mechanism 30 of this embodiment in detail. The mechanism case 31 is omitted in FIG. 5. The wheel mechanism 30 may include a first wheel 32, a second wheel 33, and an interlocking gear train 23, in addition to the mechanism case 31. The first wheel 32, the second wheel 33, and the interlocking gear train 23 may be housed in the mechanism case 31. A driving shaft 34 of the wheel mechanism 30 may be connected to the reduction gear train 22.

Figure 4:
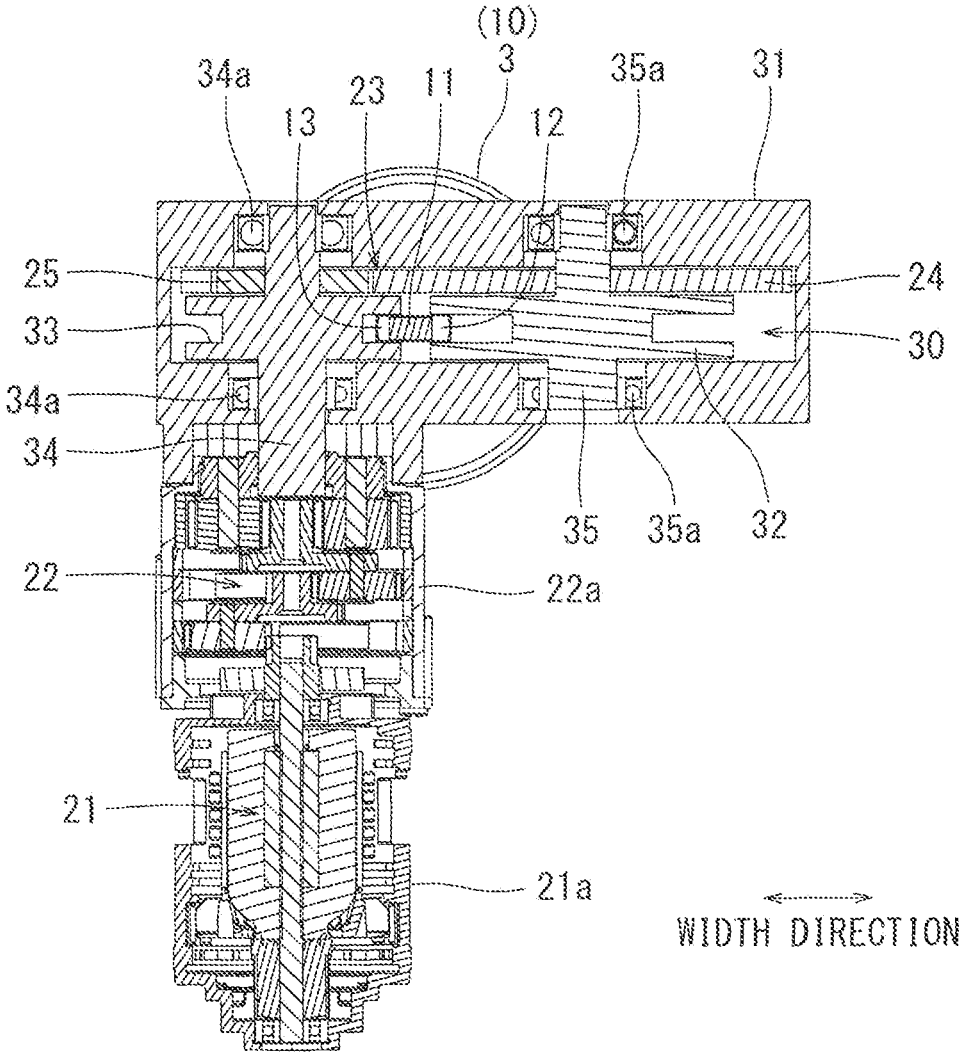
FIG. 4 is a cross-sectional view taken from line IV-IV of FIG. 2, showing a longitudinal cross-sectional view of a driving section.

As shown in FIGS. 1 and 4, the driving shaft 34 may be rotatably supported by the mechanism case 31 via two bearings 34*a*. The second wheel 33, which may be integral with a second interlocking gear 25, may be attached to the driving shaft 34. A driven shaft 35 may be provided parallel to the driving shaft 34 supported by the mechanism case 31. As shown in FIG. 4, the driven shaft 35 may be rotatably supported by the mechanism case 31 via two bearings 35*a*. The first wheel 32, which may be integral with a first interlocking gear 24, may be attached to the driven gear 35.

As shown in FIGS. 3 and 4, the driving shaft 34 may be disposed on one side in a width direction of the driver 11, and the driven shaft 35 may be disposed on the other side in the width direction of the driver 11. That is, the driving shaft 34 may be disposed apart from the driven shaft 35 by a predetermined length. The driving shaft 35 may face the driven shaft 35, with the driver 11 interposed therebetween. Because of this configuration, the first wheel 32 and the first interlocking gear 24 may be disposed on the one side in the width direction of the driver 11 (e.g., a right side in FIGS. 3 and 4). Also, the second wheel 33 and the second interlocking gear 25 may be disposed on the other side in the width direction of the driver 11 (e.g., a left side in FIGS. 3 and 4).

A spur gear may be used for both the second interlocking gear 25 on the driving shaft 34 and for the first interlocking gear 24 on the driven shaft 35. The second interlocking gear 25 may engage the first interlocking gear 24. A gear ratio of the first interlocking gear 24 to the second interlocking gear 25 may be configured to be two to one. Because of this configuration, the driven shaft 35 may rotate in accordance with the driving shaft 34 with a ratio of rotation speed being reduced by one-half. In other words, when the driving shaft 34 rotates twice, the driven shaft 35 may rotate once.

Because a ratio of the rotation number of the driving shaft 34 to the driven shaft 35 is two to one, a ratio of the rotation number of the first wheel 32 to the second wheel 33 may be one to two. In other words, when the second wheel 33 rotates twice, the first wheel 32 rotates once.

As shown in FIG. 3, the first wheel 32 may include a total of eight first engaging portions 32*a*. As shown in FIG. 5, each of the first engaging portions 32*a* may form a round column shape. Also, each end of the first engaging portions 32*a* may be supported by unnumbered parts of the first wheel 32, for instance as shown in FIG. 5. The eight first engaging portions 32*a* may be disposed at equal intervals along a same circumferential arc. Furthermore, the eight first engaging portions 32*a* may be disposed in an area around approximately half the circumference of the driven shaft 35. The area where the eight first engaging portions 32*a* are disposed in the circumferential direction may correspond to a first circumferential engaging area. In contrast, a remaining almost-semicircular area where the eight first engaging portions 32*a* are not disposed may correspond to a first circumferential non-engaging area. When the driver 11 moves downward, engaging teeth 12*a* of a first rack 12 may face the first circumferential non-engaging area. Because of this, when the driver 11 moves downward, the engaging teeth 12*a* of the first rack 12 may not interfere with the first engaging portions 32*a* of the first wheel 32. Thus, the driver 11 may move downward in a smooth manner and the thrust power in the accumulation chamber 3*a* may not be dissipated.

The second wheel 33 may include one second engaging portion 33*a*. Similar to the first engaging portions 32*a*, the second engaging portion 33*a* may form a round column shape and each end of the second engaging portion 33*a* may be supported by unnumbered parts of the second wheel 33, for instance as shown in FIG. 5. The second engaging portion 33*a* may work as an engaging portion when an upward movement of the driver 11 starts. The second engaging portion 33*a* may also work as an engaging portion when the upward movement of the driver 11 is released. For this reason, the second engaging portion 33*a* may correspond to a common engaging portion. The second engaging portion 33*a* of the second wheel 33 may have a roller structure in which a roller is rotatably supported via a shaft. A predetermined circumferential area where the second engagement portion 33*a* is disposed may correspond to a second circumferential engaging area. When the driver 11 moves upward, the second rack 13 may face the second circumferential engaging area. In contrast, a remaining circumferential area where the second engaging portion 33*a* is not disposed may correspond to a second circumferential non-engaging area. When the driver 11 moves downward, the second rack 13 may face the second circumferential non-engaging area for at least a part of the downward movement. Because of this, when the driver 11 moves downward, engaging teeth 13*a*, 13*b* of the second rack 12 may not interfere with the second engaging portions 33*a* of the second wheel 32. Thus, the driver 11 may move downward in a smooth manner.

Figure 6:
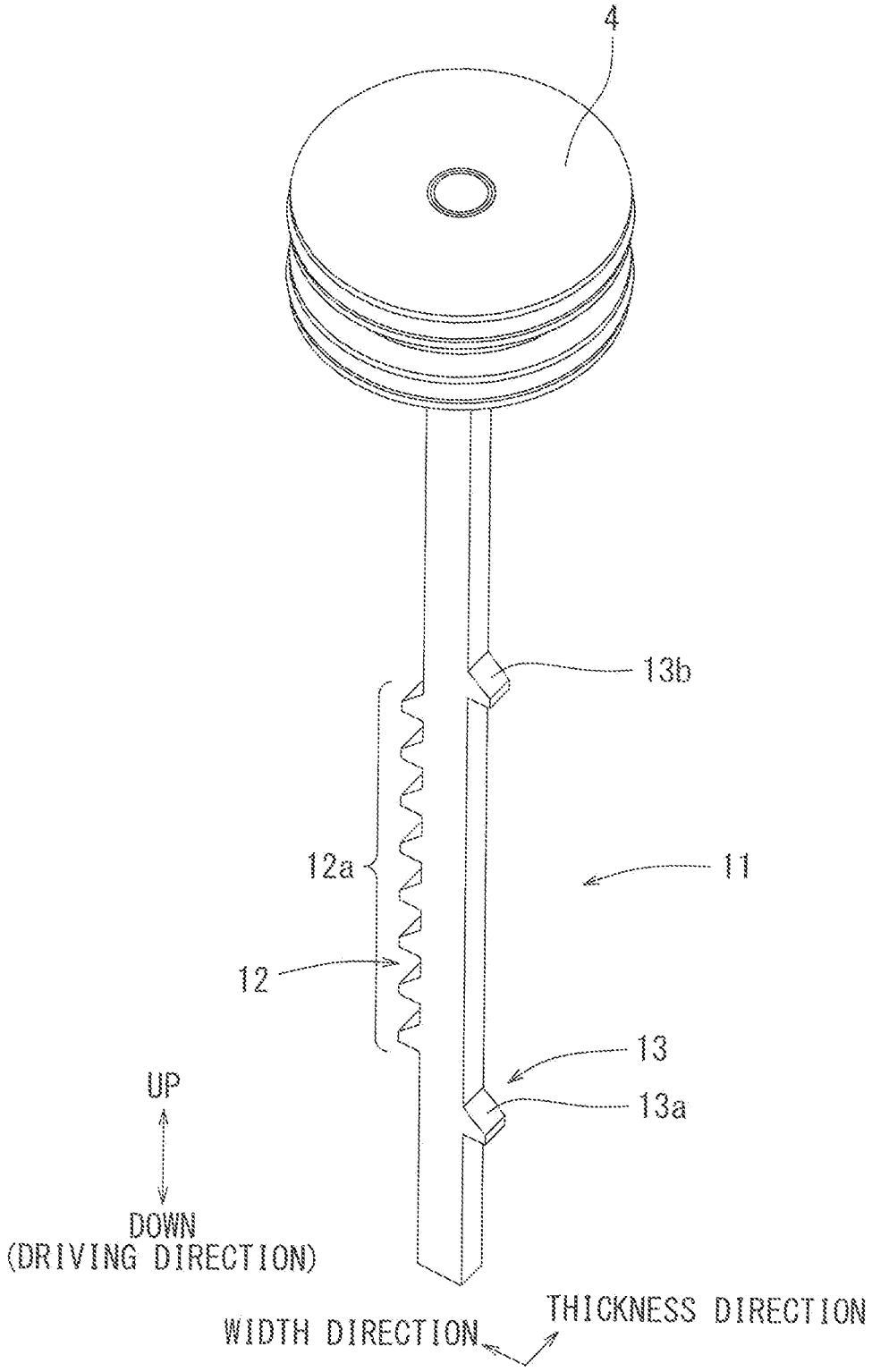
FIG. 6 is a perspective view of a driver according to the first embodiment.
Figures 7A, 7B, 7C, 7D, 7E:
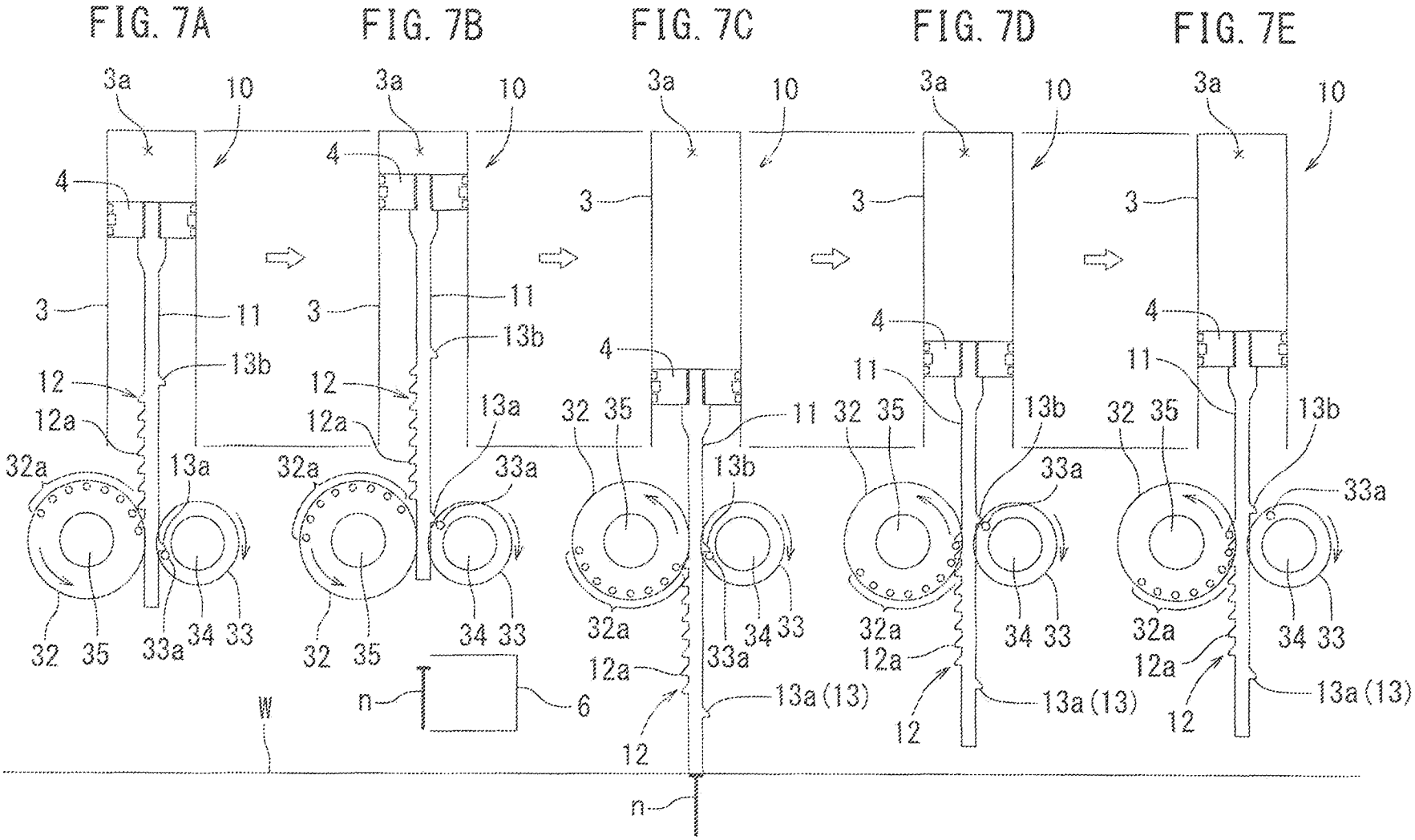
FIG. 7 (A) to FIG. 7 (E) respectively shows an operating state of the driver-returning mechanism according to the first embodiment.
Figure 8:
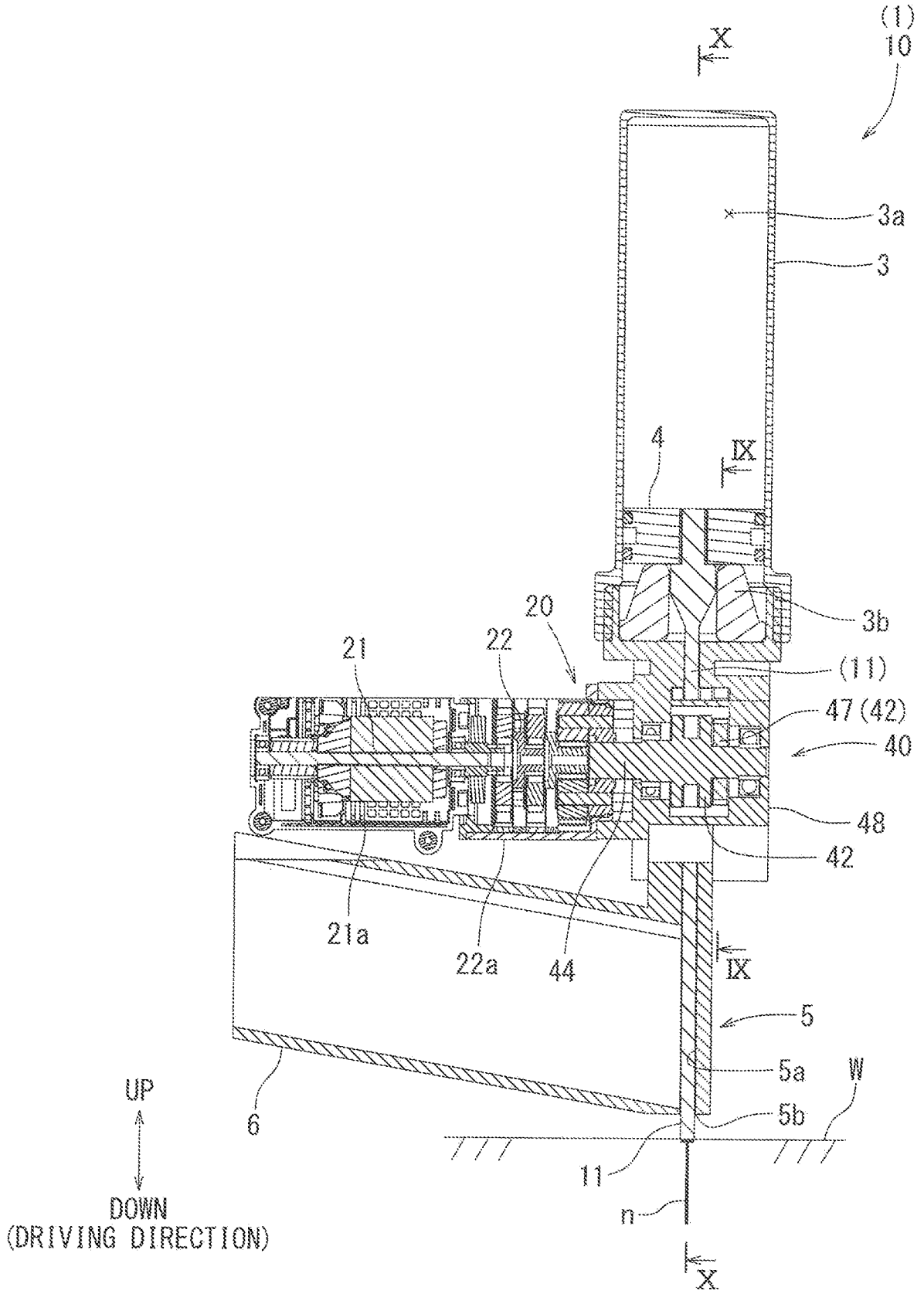
FIG. 8 is a longitudinal sectional view of a driving tool according to a second embodiment of the present disclosures.
Figure 9:
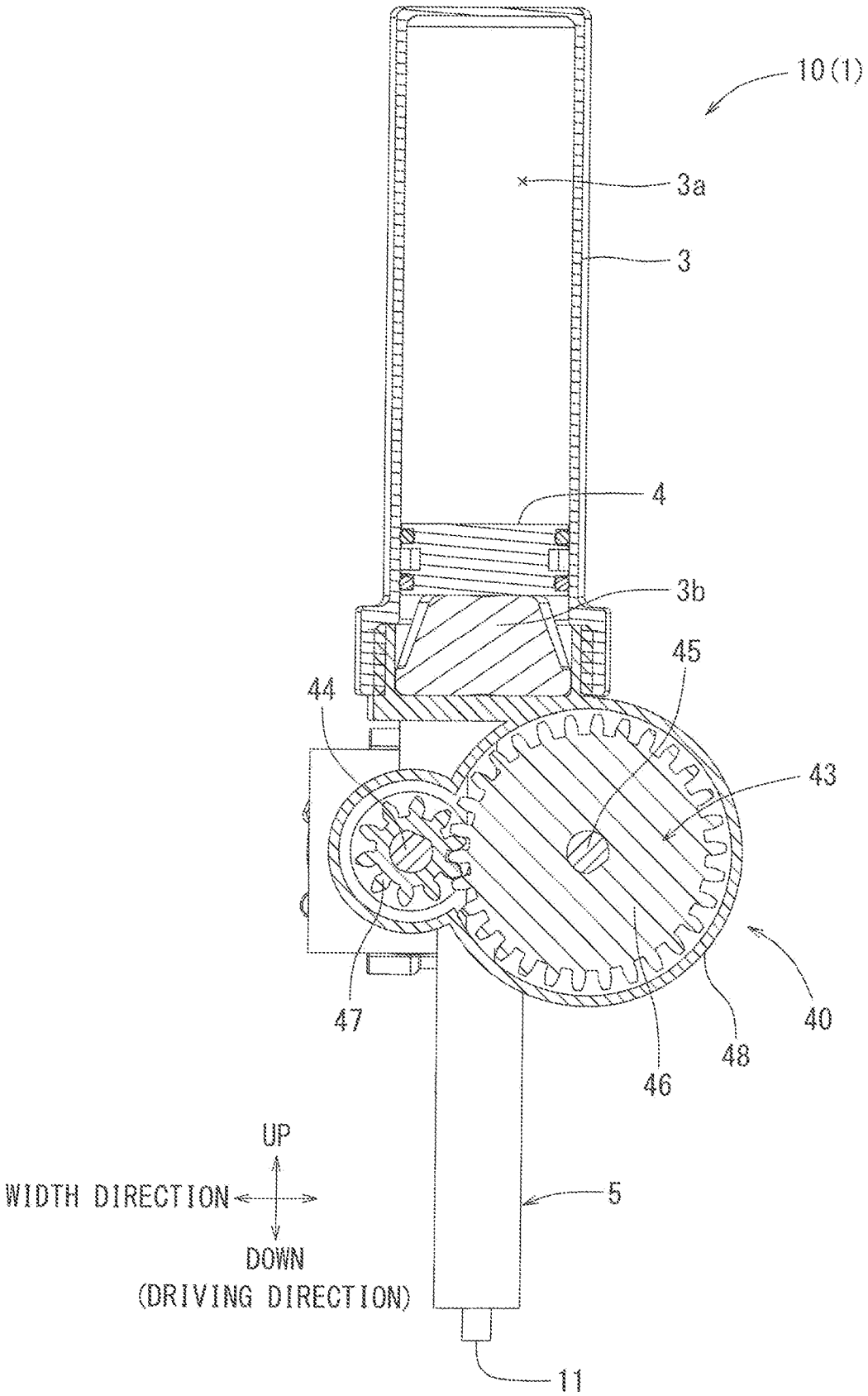
FIG. 9 is a cross-sectional view taken along line IX-IX of FIG. 8, showing a transversal cross-sectional view of a reduction gear.

As shown in FIGS. 3, 5, and 6, the driver 11 may include a first rack 12 engageable with the first wheel 32 and the second rack 13 engageable with the second wheel 33. The first rack 12 may be provided along the lateral surface of one side of the driver 11 in the width direction of the driver 11 (e.g., on the side where the first wheel 32 is disposed). The first rack 12 may include a plurality of engaging teeth 12*a* (e.g., eight engaging teeth 12*a* in FIGS. 3 and 6). The second rack 13 may be provided along the lateral surface of the other side of the driver 11 in the width direction of the driver 11 (e.g., on the side where the second wheel 33 is disposed). As shown in FIG. 3, the second rack 13 may include two engaging teeth 13*a*, 13*b*.

The engaging teeth 13*a*, 13*b* of the second rack 13 may have a higher strength and wear resistance than the engaging teeth 12*a* of the first rack 12. For example, a heat treatment or surface treatment may be locally applied to the engaging teeth 13*a*, 13*b* of the second rack 13 in order to increase their strength and wear resistance.

As shown in FIG. 6, the lower engaging tooth 13*a* of the second rack 13 may be disposed below a lowermost engaging tooth 12*a* of the first rack 12 in the up-down direction. Also, the upper engaging tooth 13*b* of the second rack 13 may be disposed above an uppermost engaging tooth 12*a* of the first rack 12 in the up-down direction. By rotation of the first wheel 32 and the second wheel 33, an engaging position of the engaging teeth 12*a*, 13*a*, 13*b* of the first rack 12 and the second rack 13 may vary to return the driver 11 upward.

FIGS. 7(A) to 7(E) show a series of states where the driver 11 and the driving piston 4 return upward by an operation of the driver-returning mechanism 20. FIG. 7 (A) shows a standby state (initial state). In this state, the driving piston 4 may be disposed slightly below a top dead center. Also in this state, a hindmost of the first engaging portions 32*a* in the first circumferential engaging area of the first wheel 32 may engage the lowermost engaging tooth 12*a* of the first rack 12 from below, for example as shown in FIG. 7 (A). Also, the second engaging portion 33*a* of the second wheel 33 may engage the lower engaging tooth 13*a* of the second rack 13 from below. In this state, the first wheel 32 and the second wheel 33 may engage the first rack 12 and the second rack 13, respectively, at the same time.

In this standby state, when the switch lever 8 is pulled, the driver-returning mechanism 20 may be actuated. When the switch lever 8 is pulled to activate the electric motor 21, the second wheel 33 may rotate, for instance in the clockwise direction as indicated by an arrow in the figures. In accordance with the rotation of the second wheel 33, the first wheel 32 may rotate, for instance in the counterclockwise direction, via the interlocking gear train 23. The first wheel 32 may rotate in a direction opposite to the second wheel 33, for instance at half the rotation speed of the second wheel 33.

When the first wheel 32 rotates, for instance in the counterclockwise direction, the hindmost first engaging portion 32*a* may disengage from the lowermost engaging tooth 12*a* of the first rack 12. At the same time, the second wheel 33 may also rotate, for instance in the clockwise direction, engaging the second engaging portion 33*a* with the lower engaging tooth 13*a* of the second rack 13 from below. As a result, the driver 11 and the driving piston 4 may move upward. Because of this movement, the driving piston 4 may return to its top dead center, for instance as shown in FIG. 7 (B). FIG. 7 (B) shows a state before a driving operation is performed (which may be a final state of an upward movement of the driver 11). In this state, one driving member n, for instance from the magazine 6, may be supplied, or may have already been supplied, into the driving passage 5*a*.

When the driving piston 4 reaches the top dead center, the gas pressure in the accumulation chamber 3*a* may have increased. Owing to this, in the state before the driving operation is performed, a large load (a thrust power in the accumulation chamber 3*a* and a rotation power of the second wheel 33) may be applied to the second engaging portion 33*a* of the second wheel 33. For instance, the thrust power in the accumulation chamber 3*a* may be applied to the second engaging portion 33*a* via the lower engaging tooth 13*a* of the second rack 13.

When the driving piston 4 reaches or is approximately at the top dead center and the second wheel 33 further rotates, for instance in the clockwise direction, from the state before the driving operation is performed, for example from the state shown in FIG. 7 (B), the second engaging portion 33*a* may disengage from the lower engaging tooth 13*a* of the second rack 13. That is, a returning operation of the driver 11 being performed by the driver-returning mechanism 20 (which may be related to the engagement state of the second engaging portion 33*a*) may be released. At this time, a large friction force may be applied to the second engaging portion 33*a*. After the second engaging portion 33*a* disengages from the lower engaging tooth 13*a* of the second rack 13, the driving piston 4 may move downward, owing to the gas pressure in the accumulation chamber 3*a*, which serves as the thrust power, for instance as shown in FIG. 7 (C). In accordance with the downward movement of the driving piston 4, the driver 11 may move downward in the driving passage 5*a*. During the downward movement of the driver 11, the one driving member n supplied into the driving passage 5*a* may be driven by the tip end of the driver 11. As a result, the driving member n may be driven from the injection port 5*b* and into a workpiece W.

While the driving piston 4 moves downward, the electric motor 21 may continue to rotate. During this period, the first wheel 32 may rotate in a direction opposite to the second wheel 33 of the driver-returning mechanism 20. While the driver 11 moves downward, the circumferential non-engaging area of the first wheel 32 (e.g., the almost-semicircular area where there is no first engaging portion 32*a*) may face one surface of the driver 11, and the circumferential non-engaging area of the second wheel 33 (e.g., the circumferential area where there is no second engaging portion 33*a*) may face the other surface of the driver 11. Because of this configuration, the first engaging portions 32*a* of the first wheel 32 and the second engaging portion 33*a* of the second wheel 33 may be prevented from interfering with the driver 11. As a result, the driver 11 may be allowed to move downward in a smooth manner.

When the driving piston 4 reaches its a lower position, the driving operation may be completed. During this period, the first wheel 32 and the second wheel 33 may continue to rotate. After the driving operation has been completed, the second engaging portion 33*a* of the second wheel 33 may engage the upper engaging tooth 13*b* of the second rack 13 from below, for instance as shown in FIG. 7 (C). As previously mentioned, after the second engaging portion 33*a* of the second wheel 33 disengages from the lower engaging tooth 13*a* of the second rack 13, the downward movement of the driving piston 4 may be started. After the driving piston 4 reaches a lower position, the second engaging portion 33*a* may engage the upper engaging tooth 13*b* of the second rack 13 from below. Because of this configuration, the second engaging portion 33*a* of the second wheel 33 may work as a release-engaging portion that allows the driving piston 4 to move downward as well as a start-engaging portion that assists with moving the driver 11 upward. That is, the second engaging portion 33*a* may work as a common engaging portion for assisting with both starting and releasing the engagement with the second rack 13.

After the driving piston 4 reached a lower position, for instance shown in FIG. 7 (C), the electric motor 21 may continue to rotate. Accordingly, the driver-returning mechanism 20 may continue to be operated. FIG. 7 (D) shows a return-start stage (e.g., a stage of the upward movement of the driver 11) where the second wheel 33 rotates, for instance in the clockwise direction, while the second engaging portion 33*a* of the second wheel 33 engages the upper engaging tooth 13*b* of the second rack 13 from below. As a result, the driver 11 may move upward. Also, the first wheel 32 may rotate, for instance in the counterclockwise direction, and a first engaging portion 32*a*, for instance the foremost first engaging portion 32*a* in the first circumferential engaging area, may engage the uppermost engaging tooth 12*a* of the first rack 12 from below.

As shown in FIG. 7 (E), by rotation of the first wheel 32, for instance in the counterclockwise direction, and the second wheel 33, for instance in the clockwise direction, an engagement state of the driver 11 may be transferred from the engagement of the second engaging portion 33*a* with the second rack 13 to only the engagement of the first engaging portion 32*a* with the first rack 12.

After the transfer of the engagement state shown in FIG. 7 (E), the driver 11 may continue to move upward, owing to continuous engagement of one or more of the first engaging portions 32*a* of the first wheel 32 with the engaging tooth/teeth 12*a* of the first rack 12. Then, the driving piston 4 may return to its standby position, for instance the position shown in FIG. 7 (A). During this period, in accordance with the rotation of the second wheel 33, for instance in the clockwise direction, the first wheel 32 may also rotate, for instance in the counterclockwise direction. Owing to the rotation of the first wheel 32 and the second wheel 33, the second engaging portion 33*a* of the second wheel 33 may again engage the lower engaging tooth 13*a* of the second rack 13 from below.

When the driving piston 4 returns to its standby position shown in FIG. 7 (A), the electric motor 21 may automatically stop to complete one driving cycle. When the switch lever 8 is pulled again, or when another driving cycle is to be performed, the driver-returning mechanism 20 may start again or continue to operate. Accordingly, a series of operations may be performed according to the following procedure: (A) standby state→(B) start driving operation→(C) driving operation completed→(D) start returning→(E) transfer of engagement.

According to the driving tool 1 of the first embodiment discussed above, the driver 11 may return upward by rotation of the first wheel 32 and the second wheel 33. While the driving piston 4 is returning to or is near its top dead center, the second engaging portion 33*a* of the second wheel 33 may engage the lower engaging tooth 13*a* of the second rack 13. After the driving piston 4 reaches or is near its top dead center, further rotation of the second wheel 33 may cause the release of the engagement of the second engaging portion 33*a* with the lower engaging tooth 13*a* of the second rack 13. Then, the driver 11 may be moved downward by the driving mechanism (in this embodiment by the thrust power in the accumulation chamber 3*a*) to drive the driving member n. Thus, high durability and wear resistance may be required for the second engaging portion 33*a* of the second wheel 33, which works as the engaging portion for releasing the engaging state from the second rack 13.

Furthermore, the second engaging portion 33*a* of the second wheel 33 may work as the starting engaging portion for moving the driver 1I upward when the driving piston 4 returns to its standby position (e.g., during the positions shown FIG. 7 (C) to FIG. 7 (D)). In this state, a relatively large load and friction force may be applied to the second engaging portion 33*a*. In this way, by applying the large load and friction force to the second engaging portion 33*a* of the second wheel 33 when the engagement starts and releases, a load applied to the first engaging portions 32*a* of the first wheel 32 may be reduced. Thus, by providing the second engaging portion 33*a* of the second wheel 33 with the necessary strength and wear resistance, a cost of production may be reduced in comparison with a case where a total mechanism, for instance including the first wheel 32, is provided with high strength and wear resistance. When a degree of wear progresses, it may be sufficient to merely replace the second engaging portion 33*a* of the second wheel 33. The original first wheel 32 may continue to be used. As a result, a cost of maintenance may be reduced.

Furthermore, according to the driving tool 1 of the first embodiment discussed above, the first wheel 32 may be disposed on one lateral side of the driver 11 in the width direction of the driver 11 and the second wheel 33 may be disposed on the other lateral side of the driver 11. Because of this configuration, the driver 11 may engage the first wheel 32 and the second wheel 33 from both sides in the width direction of the driver 11. As a result, when the driver 11 moves in the up-down direction, the driver 11 may be restricted from excessively displacing (tilting) to one side in the width direction of the driver 11.

Furthermore, the second engaging portion 33*a* of the second wheel 33 may work as the common engaging portion for both the start-engaging portion and release-engaging portion. Because of this configuration, simplification of structure may be obtained. The second engaging portion 33*a* of the second wheel 33 may have a roller structure in which the roller is rotatably supported via the shaft. Because of this configuration, wear resistance of the second engaging portion 33*a* may be further improved.

Furthermore, according to the driving tool 1 of the first embodiment discussed above, the ratio of the rotation speed of the first wheel 32 to the second wheel 33 may be configured to one to two (or at another integer ratio). Because of this configuration, the driver returning mechanism 20 may be simple and reliable. Especially, rotation speed of the second wheel 33 may be configured to be twice as large as that of the first wheel 32. Thus, the second wheel 33 may be compact, while still being able to cooperate with the first wheel 32.

Furthermore, the engaging teeth 13*a*, 13*b* of the second rack 13, both of which engage the second engaging portion 33*a* of the second wheel 33, may have a higher strength as compared to the engaging teeth 12*a* engageable with the first engaging portion 32*a* of the first wheel 32. By increasing the strength of only the necessary portion(s), a required cost of production, as well as of maintenance, may be reduced.

It is noted that the present teachings are not limited to the above-discussed embodiment, and it is understood that variations and modifications may be effected without departing from the spirit and scope of the present teachings. For example, the first embodiment shows that the ratio of rotation number of the first wheel 32 to the second wheel 33 is configured to be one to two, via the interlocking gear train 23. However, a ratio of rotation number of the first wheel 32 to the second wheel 33 may be modified in various ways, as long as the ratio is an integer ratio. For example, FIGS. 8 to 11 show a driving tool 1 according to a second embodiment, in which a ratio of rotation number of the first wheel 41 to the second wheel 42 is configured to one to three. The driving tool 1 according to the second embodiment 2 primarily differs in a wheel structure 40 of the driver-returning mechanism 20. Descriptions of the members and configurations that do not need to be substantially modified and are essentially in common with the first embodiment are omitted by use of the same reference numerals.

A driver-returning mechanism 20 according to the second embodiment includes an electric motor 21 powered by a battery pack 9 serving as the electric power source. The driver-returning mechanism 20 also includes a reduction gear train 22 that reduces the rotation output of the electric motor 21. These components are essentially the same as those of the first embodiment. An output of the reduction gear train 22 may be input to a driving shaft 44 of the wheel mechanism 40. The wheel mechanism 40 may include a mechanism case 48 that has approximately the same shape as the mechanism case 31 of the first embodiment. A first wheel 41, a second wheel 42, and an interlocking gear train 43 may be housed in the mechanism case 48. The first wheel 41 may be disposed on one side of the driver 11 in the width direction of the driver 11, and the second wheel 42 may be disposed on the other side of the driver in the width direction of the driver. This arrangement is basically the same as in the first embodiment.

The interlocking gear train 43 may include a first interlocking gear 46 and a second interlocking gear 47, each of which is a spur gear. The second interlocking gear 47 may be linked to a driving shaft 44, and the first interlocking gear 46 may be connected to a driven shaft 45. A number of teeth of the first interlocking gear 46 on the driven side may be configured to be three times that of the second interlocking gear 47 on the driving side. Thus, a rotation speed of the driven shaft 45 may be one third of that of the driving shaft 44.

Similar to the first embodiment, a second wheel 42 may be attached to the driving shaft 44 and a first wheel 41 may be attached to the driven shaft 45. Thus, a rotation speed of the first wheel 41 may be configured to one third of that of the second wheel 42. When the first wheel 41 rotates once, the second wheel 42 may rotate three times. Similar to the first embodiment, each of the driving shaft 44 and the driven shaft 45 of the second embodiment may be rotatably supported by the mechanism case 48, via bearings.

Figure 10:
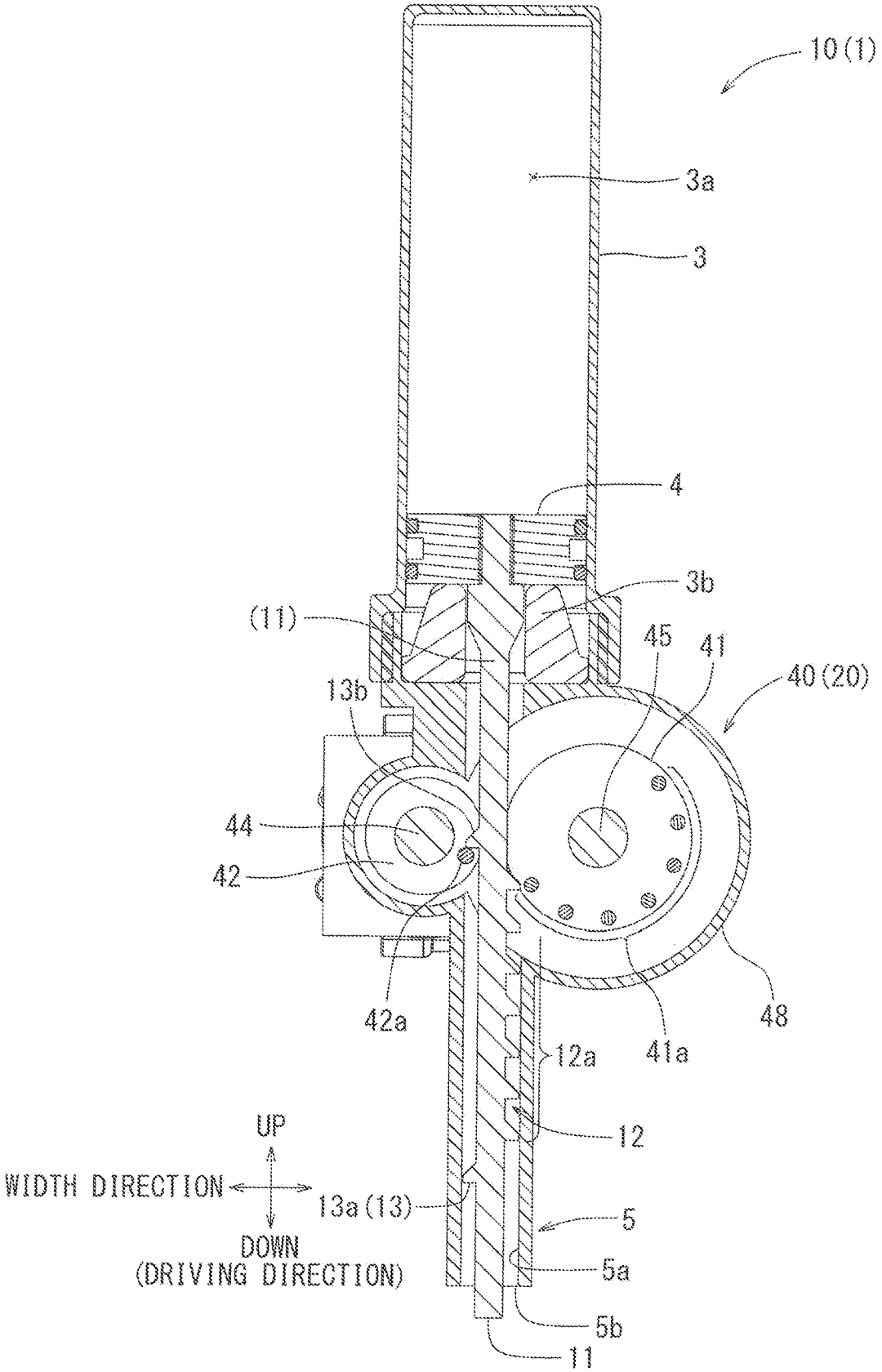
FIG. 10 is a cross-sectional view taken along line X-X of FIG. 8, showing a transversal cross-sectional view of a drive-returning mechanism.
Figures 11F, 11G, 11H, 11I, 11J, 11K:
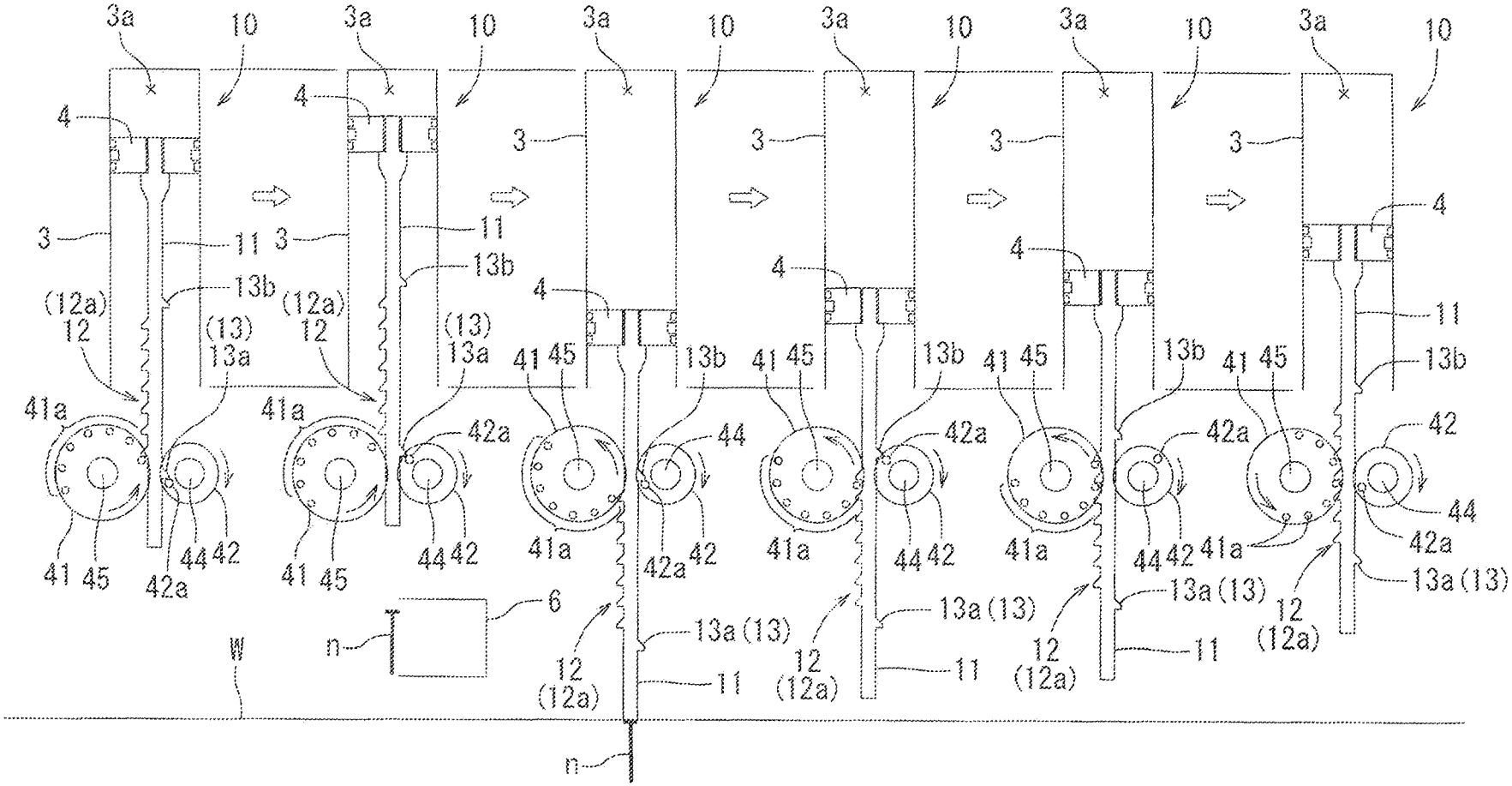
FIG. 11 (F) to FIG. 11 (K) respectively shows an operating state of the driver-returning mechanism according to the second embodiment.
Figure 12:
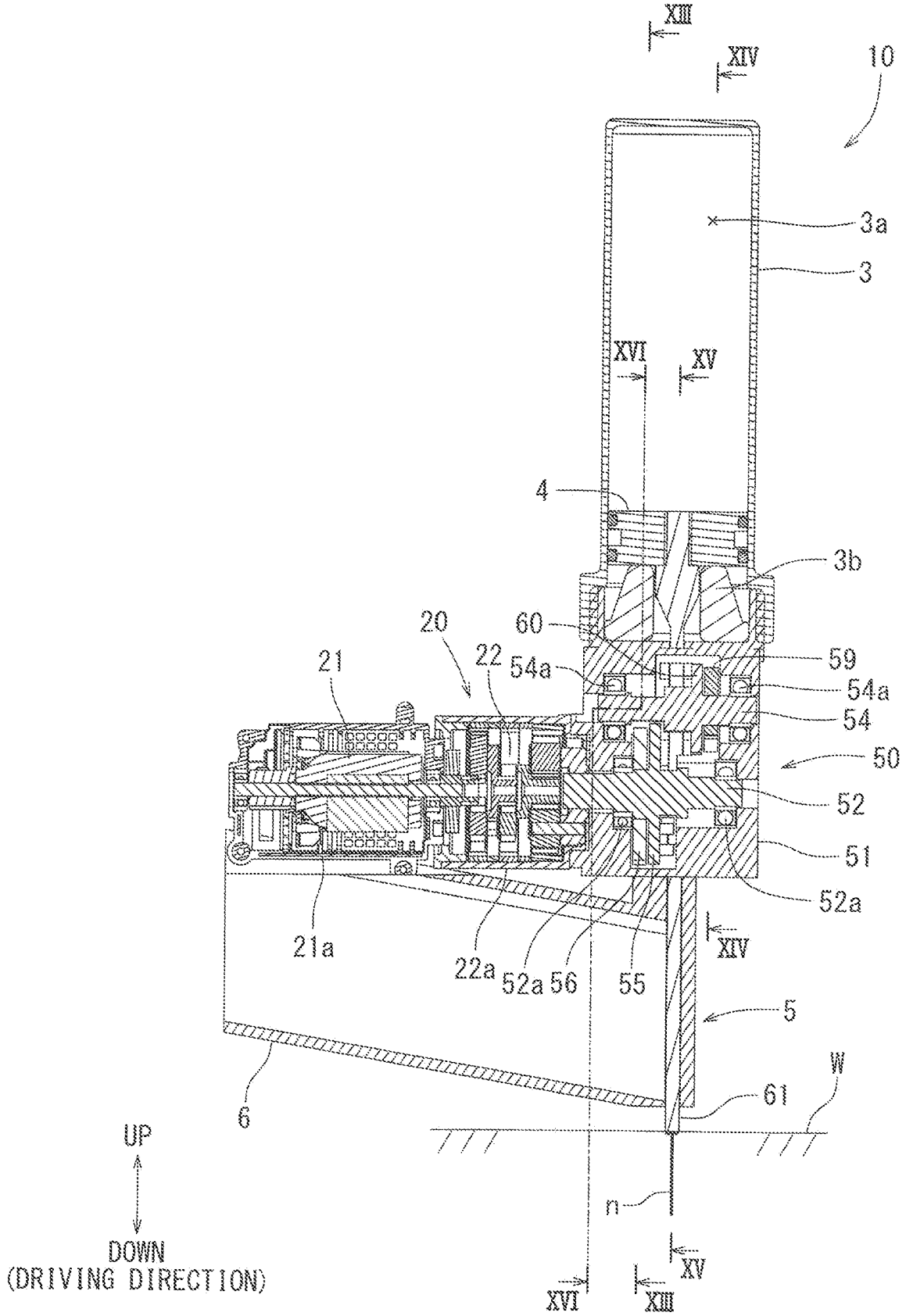
FIG. 12 is a longitudinal sectional view of a driving tool according to a third embodiment of the present disclosures.

As shown in FIG. 10, the first wheel 41 may include a plurality, for example a total of seven, first engaging portions 41*a*. Each of the first engaging portions 41*a* may form a round column shape. Also, each end of the first engaging portions 41*a* may be supported by unnumbered parts of the first wheel 41, in a similar fashion as in the first embodiment. The seven first engaging portions 41*a* may be disposed at equal intervals along a same circumferential direction of the first wheel 41. Furthermore, the seven first engaging portions 41*a* may be disposed in an area slightly larger than an area of approximately half the circumference around the driven shaft 41*a*. Thus, the first engaging portions 41*a* may be disposed over a slightly broader area of the first wheel 41, in comparison to the first portions 32*a* of the first wheel 32 of the first embodiment. Because of this configuration, the seven first engaging portions 41*a* of the second embodiment may be disposed at larger intervals in the circumferential direction than the eight first engaging portions 32*a* according to the first embodiment. The area where the seven first engaging portions 41*a* of the second embodiment are disposed in the circumferential direction of the first wheel 41 may correspond to the first circumferential engaging area. The remaining almost-semicircular area of the first wheel 41 where the seven first engaging portions 41*a* are not disposed may correspond to the first circumferential non-engaging area. In this way, the first wheel 41 according to the second embodiment may include a total of seven first engaging portions 41*a*, while the first wheel 32 according to the first embodiment may include a total of eight first engaging portions 32*a*.

As discussed above, the total number and the disposed interval (within the area of the first circumferential engaging area) of the first engaging portions 41*a* may differ from those of the first embodiment. Because of this difference, a ratio of the rotation number of the first wheel 41 to the second wheel 42 may be one to three, whereas that of the first embodiment may be one to two.

The second wheel 42 of the second embodiment may include one second engaging portion 42*a*. Similar to the first engaging portions 41*a*, the second engaging portion 42*a* may form a round column shape and each end of the second engaging portion 42*a* may be supported by unnumbered parts of the second wheel 42. The second engaging portion 42*a* may work as an engaging portion when an upward movement of the driver 11 is performed. The second engaging portion 42*a* may also work as an engaging portion when the upward movement of the driver 11 is released. For this reason, the second engaging portion 33*a* may correspond to a common engaging portion. The second engaging portion 42*a* of the second wheel 42 may have a roller structure in which a roller is rotatably supported by a shaft. The second wheel 42 according to the second embodiment may have substantially the same general configuration as the second wheel 33 according to the first embodiment.

As shown in FIG. 10, the driver 11 of the second embodiment may include a first rack 12 engageable with the first wheel 41 and a second rack 13 engageable with the second wheel 42. The first rack 12 may be provided along a lateral surface on one side of the driver 11 in the width direction of the driver 11 (e.g., on a side where the first wheel 41 is disposed). The first rack 12 of the second embodiment may include a total of seven engaging teeth 12*a*. Thus, the first rack 12 of the second embodiment may differ from that of the first embodiment in that the first rack 12 of the second embodiment includes a total of seven, rather than eight, engaging teeth 12*a*. The second rack 13 may be provided along a lateral surface of the driver 11 on another side of the driver 11 in the width direction of the driver 11 (e.g., on a side where the second wheel 42 is disposed). As shown in FIG. 10, the second rack 13 may include two engaging teeth 13*a*, 13*b*.

Similar to the first embodiment, the engaging teeth 13*a*, 13*b* of the second rack 13 of the second embodiment may have a higher strength and wear resistance than the engaging teeth 12*a* of the first rack 12. For example, a heat treatment or surface treatment may be locally applied to the engaging teeth 13*a*, 13*b* in order to increase their strength and wear resistance.

As shown in FIG. 10, the lower engaging tooth 13*a* of the second rack 13 may be disposed offset, for example below, a lowermost engaging tooth 12*a* of the first rack 12 in the up-down direction. Also, the upper engaging tooth 13*b* of the second rack 13 may be disposed above an uppermost engaging tooth 12*a* of the first rack 12 in the up-down direction.

By rotation of the first wheel 41 and the second wheel 42, an engaging position of the engaging teeth 12*a*, 13*a* of the first rack 12 and the second rack 13 may vary to return the driver 11 upward, which is similar to that of the first embodiment. FIGS. 11 (F) to 7(K) show a series of states where the driver 11 and the driving piston 4 return upward by an operation of the driver-returning mechanism 20 according to the second embodiment. FIG. 11 (F) shows a standby state (for instance an initial state) where the driving piston 4 is disposed slightly below a top dead center. In this state, a first engaging portion 41*a*, for instance a hindmost first engaging portion 41*a* in the first circumferential engaging area of the first wheel 41, may engage the lowermost engaging tooth 12*a* of the first rack 12 from below, for example as shown in FIG. 11 (F). Also in this state, the second engaging portion 42*a* of the second wheel 42 may engage the lower engaging tooth 13*a* of the second rack 13 from below. In this state, the first wheel 41 and the second wheel 42 may engage the first rack 12 and the second rack 13, respectively, at the same time.

In this standby state, when the switch lever 8 is pulled, the driver-returning mechanism 20 may be actuated. When the switch lever 8 is pulled to activate the electric motor 21, the second wheel 42 may rotate, for instance in the clockwise direction as indicated by an arrow in the figures. In accordance with the rotation of the second wheel 42, the first wheel 41 may rotate, for instance in the counterclockwise direction, via the interlocking gear train 43. The first wheel 41 may rotate in a direction opposite to the second wheel 42 at one third the rotation speed of the second wheel 42.

When the first wheel 41 rotates, for example in the counterclockwise direction, the hindmost first engaging portion 41*a* may disengage from the lowermost engaging tooth 12*a* of the first rack 12. At the same time, the second wheel 42 may also rotate, for instance in the clockwise direction, while continuing to engage the second engaging portion 42*a* with the engaging tooth 13*a* of the second rack 13 from below. As a result, the driver 11 and the driving piston 4 may move upward. Because of this movement, the driving piston 4 may return to or near its top dead center, for instance as shown in FIG. 11 (G). FIG. 11 (G) shows a state before a driving operation is performed. In this state, one driving member n may be or have already been supplied into the driving passage 5*a* from the magazine 6.

When the driving piston 4 reaches the top dead center, the gas pressure in the accumulation chamber 3*a* may increase. Owing to this, in the state before the driving operation is performed, a large load (for example due to the thrust power in the accumulation chamber 3*a* and the rotation power of the second wheel 42) may be applied to the second engaging portion 42*a* of the second wheel 42. For example, the load from the thrust power in the accumulation chamber 3*a* may be transferred to the second engaging portion 42*a* via the lower engaging tooth 13*a* of the second rack 13.

When the driving piston 4 reaches or is near the top dead center and the second wheel 42 further rotates clockwise from the state before the driving operation is performed, for example that shown in FIG. 11 (G), the second engaging portion 42*a* may disengage from the lower engaging tooth 13*a* of the second rack 13. That is, a returning operation of the driver 11 by the driver-returning mechanism 20 (which may correspond to an engagement state of the second engaging portion 42*a*) may be released. At this time, a large friction force may be applied to the second engaging portion 42*a*. When the second engaging portion 42*a* disengages from the lower engaging tooth 13*a* of the second rack 13, the driving piston 4 may move downward owing to the gas pressure in the accumulation chamber 3*a* serving as the thrust power, for instance to enter a state similar to that shown in FIG. 11 (H). In accordance with the downward movement of the driving piston 4, the driver 1I may move downward in the driving passage 5*a*. During the downward movement of the driver 11, the one driving member n supplied into the driving passage 5*a* may be driven by the tip end of the driver 11. As a result, the driving member n may be driven from the injection port 5*b* and into the workpiece W.

While the driving piston 4 moves downward, the electric motor 21 may continue to rotate. During this period, the first wheel 41 may rotate in a direction opposite to the second wheel 42 of the driver-returning mechanism 20. While the driver 11 moves downward, the circumferential non-engaging area of the first wheel 41 (which may correspond to the semicircular area where there is no first engaging portions 41*a*) may face one surface of the driver 11. The circumferential non-engaging area of the second wheel 42 (which may correspond to the circumferential area where there is no second engaging portion 42*a*) may face the other surface of the driver 11. Because of this configuration, the first engaging portions 41*a* of the first wheel 41 and the second engaging portion 42*a* of the second wheel 42 may be prevented from interfering with the driver 11. As a result, the driver 11 may be allowed to move downward in a smooth manner.

When the driving piston 4 reaches an end position, the driving operation may be completed. During this period, the first wheel 41 and the second wheel 42 may continue to rotate. After the driving operation has been completed, the second engaging portion 42*a* of the second wheel 42 may engage the upper engaging tooth 13*b* of the second rack 13 from below, for instance as shown in FIG. 11 (H). As described above, when the second engaging portion 42*a* of the second wheel 42 disengage from the lower engaging tooth 13*a* of the second rack 13, the downward movement of the driving piston 4 may start. Then, when the driving piston 4 reaches a lower end, the second engaging portion 42*a* may engage the upper engaging tooth 13*b* of the second rack 13 from below. Because of this configuration, the second engaging portion 42*a* of the second wheel 42 may work as a release-engaging portion that allows the driving piston 4 to move downward as well as a start-engaging portion that assists with moving the driver 11 upward. That is, the second engaging portion 42*a* may work as the common engaging portion for assisting with both starting and releasing the engagement with the second rack 13.

After the driving piston 4 has reached its lower end, for instance the position shown in FIG. 11 (H), the electric motor 21 may continue to rotate. Accordingly, the driver-returning mechanism 20 may continue to be operated. FIG. 11 (I) shows a return-start stage, where the second wheel 42 rotates, for instance in the clockwise direction, while the second engaging portion 42*a* of the second wheel 42 engages the upper engaging tooth 13*b* of the second rack 13 from below. As a result, the driver 11 may move upward. Also, the first wheel 41 may rotate, for instance in the counterclockwise direction, and a first engaging portion 41*a*, for instance the foremost first engaging portion 41*a* in the first circumferential engaging area, may engage the uppermost engaging tooth 12*a* of the first rack 12 from below.

As shown in FIG. 11 (J), by rotation of the first wheel 41, for instance in the counterclockwise direction, and by the rotation of the second wheel 42, for instance in clockwise direction, an engagement state may be transferred from the engagement of the second engaging portion 42*a* with the second rack 13 to only the engagement of the first engaging portion 41*a* with the first rack 12.

After the transfer of the engagement state, for instance to that shown in FIG. 11 (J), the driver 11 may move upward owing to the continuous engagement of the first engaging portions 41*a* of the first wheel 41 with the engaging teeth 12*a* of the first rack 12, as shown in FIG. 11 (K). Then, the driving piston 4 may return to its standby position, for instance the position shown in FIG. 11 (F). During this period, in accordance with the rotation of the second wheel 42, for instance in the clockwise direction, the first wheel 41 may also rotate, for instance in the counterclockwise direction. Owing to the rotation of the first wheel 41 and the second wheel 42, the second engaging portion 42*a* of the second wheel 42 may again engage the lower engaging tooth 13*a* of the second rack 13 from below.

After the driving piston 4 has returned to its standby position, for instance the position shown in FIG. 11 (F), the electric motor 21 may automatically stop, thereby completing one driving cycle. When the switch lever 8 is pulled again or the driving cycle is otherwise started again, the driver-returning mechanism 20 may start or continue, and a series of operation may be performed according to the following procedure: (F) standby state→(G) start driving operation→(H) driving operation completed→(I) start returning→(J) transfer of engagement.

According to the driving tool 1 of the second embodiment discussed above, by applying a large load and friction force mainly to the second engaging portion 42*a* of the second wheel 42 when the engagement starts and releases, a load applied to the first engaging portions 32*a* of the first wheel 32 may be reduced. Thus, by providing the second engaging portion 42*a* of the second wheel 42 with the necessary strength and wear resistance, a cost of production may be reduced in comparison with a case where a total mechanism, including the first wheel 41, is provided with high strength and wear resistance. When a degree of wear progresses, it may be sufficient to merely replace the second engaging portion 41*a* of the second wheel 42. The original first wheel 41 may continue to be used. As a result, a cost of maintenance may be reduced.

Furthermore, according to the driving tool 1 of the second embodiment discussed above, the ratio of the rotation speed of the first wheel 41 to the second wheel 42 may be configured to one to three (or any other integer ratio). Because of this, the second wheel 42 and the second interlocking gear 47 may be made more compact (e.g., have a reduced diameter), in comparison with the second wheel 33 and the second interlocking gear 25 according to the first embodiment. As a result, the wheel mechanism 40 may be made more compact, in comparison with the wheel mechanism 30 according to the first embodiment. Thus, the driving tool 1 of the second embodiment may be made more compact, especially in the width direction.

Furthermore, according to the driving tool 1 of the second embodiment discussed above, the first wheel 41 may be disposed on one lateral side of the driver 11 in the width direction of the driver 11 and the second wheel 42 may be disposed on the other lateral side of the driver 11. Because of this configuration, the driver 11 may be engaged with the first wheel 41 and the second wheel 42 from both sides in the width direction. As a result, when the driver 11 moves upward and downward, the driver 11 may be restricted from excessively displacing (tilting) to one side in the width direction of the driver 11.

Furthermore, the second engaging portion 42*a* of the second wheel 42 may work as a common engaging portion for both the start-engaging portion and release-engaging portion. Because of this configuration, simplification of structure may be obtained. The second engaging portion 42*a* of the second wheel 42 may have a roller structure, in which the roller is rotatably supported via a shaft. Because of this configuration, wear resistance of the second engaging portion 42*a* may be further improved.

The driving tool 1 according to the first embodiment and the second embodiment may be further modified. In the first embodiment and the second embodiment, the first wheel 32, 41 may be disposed on one lateral side of the driver 11 in the width direction of the driver 11 and the second wheel 33, 42 may be disposed on the other lateral side of the driver 11 in the width direction of the driver 11. That is, a structure in which the first and second wheels are disposed on opposite sides relative to the driver 11 may be adopted in the first and second embodiments. However, in other embodiments, both the first wheel and the second may be disposed on one lateral side of the driver 11 in the width direction.

FIGS. 12 to 18 show the driving tool 1 according to a third embodiment. In the third embodiment, the wheels are disposed on one lateral side of the driver 11. A wheel mechanism 50 of the driving tool 1 according to the third embodiment may differ from the wheel mechanism 30 of the first embodiment and the wheel mechanism 40 of the second embodiment. Descriptions of the members and configurations that do not need to be substantially modified and are basically in common with the first and second embodiments are omitted by use of the same reference numerals.

The wheel mechanism 50 according to the third embodiment may include a mechanism case 51. The mechanism case 51 may be linked to the driving nose 5. A driving shaft 52, a first driven shaft 53, and a second driven shaft 54 may be rotatably supported by the mechanism case 51 via bearings 52*a*, 53*a*, 54*a*, respectively. The rotational output of an electric motor 21 may be transferred to the driving shaft 52 via a reduction gear train 22.

Figure 13:
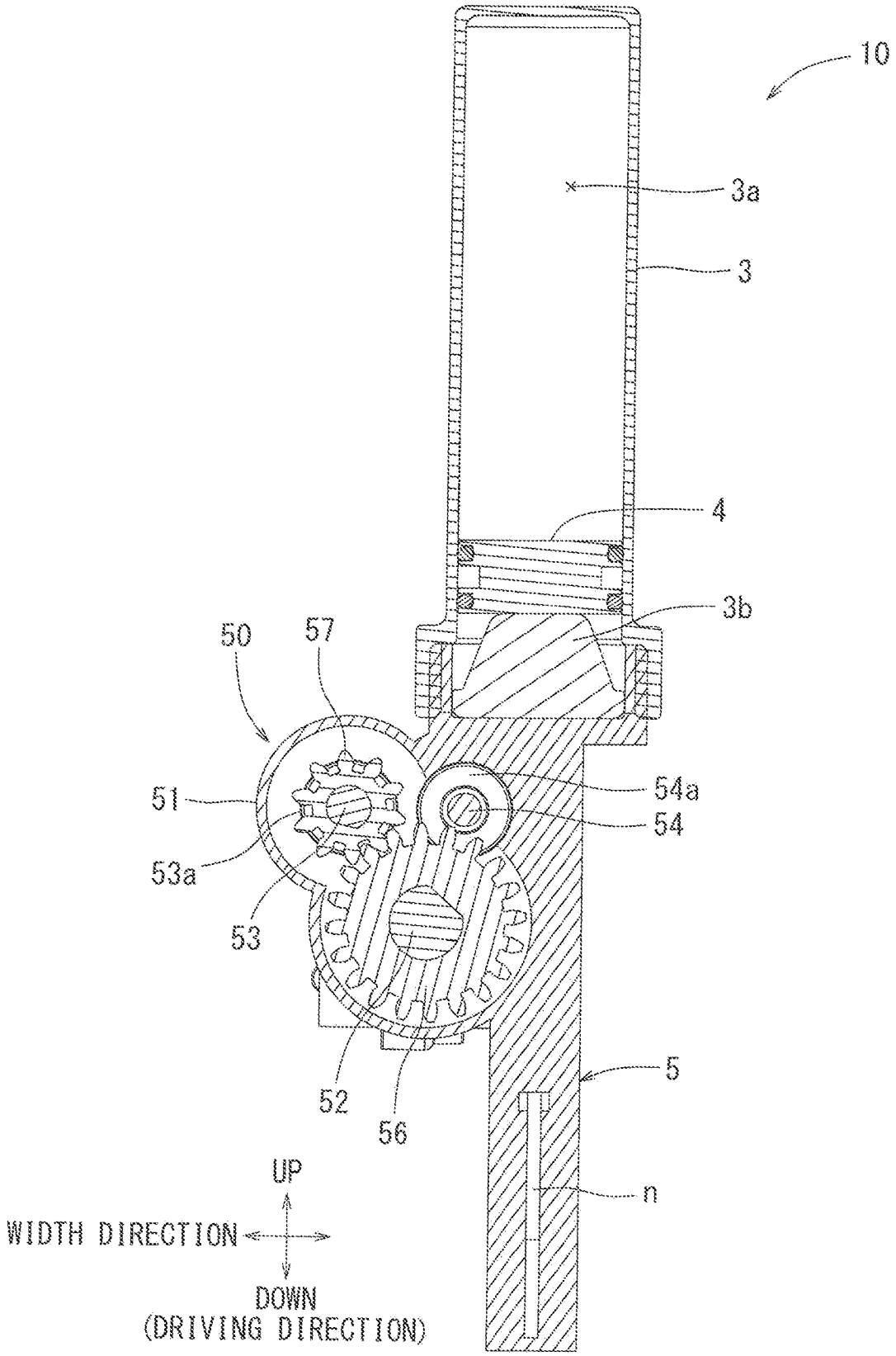
FIG. 13 is a cross-sectional view taken along line XIII-XIII of FIG. 12, showing a transversal cross-sectional view of a reduction gear.
Figure 14:
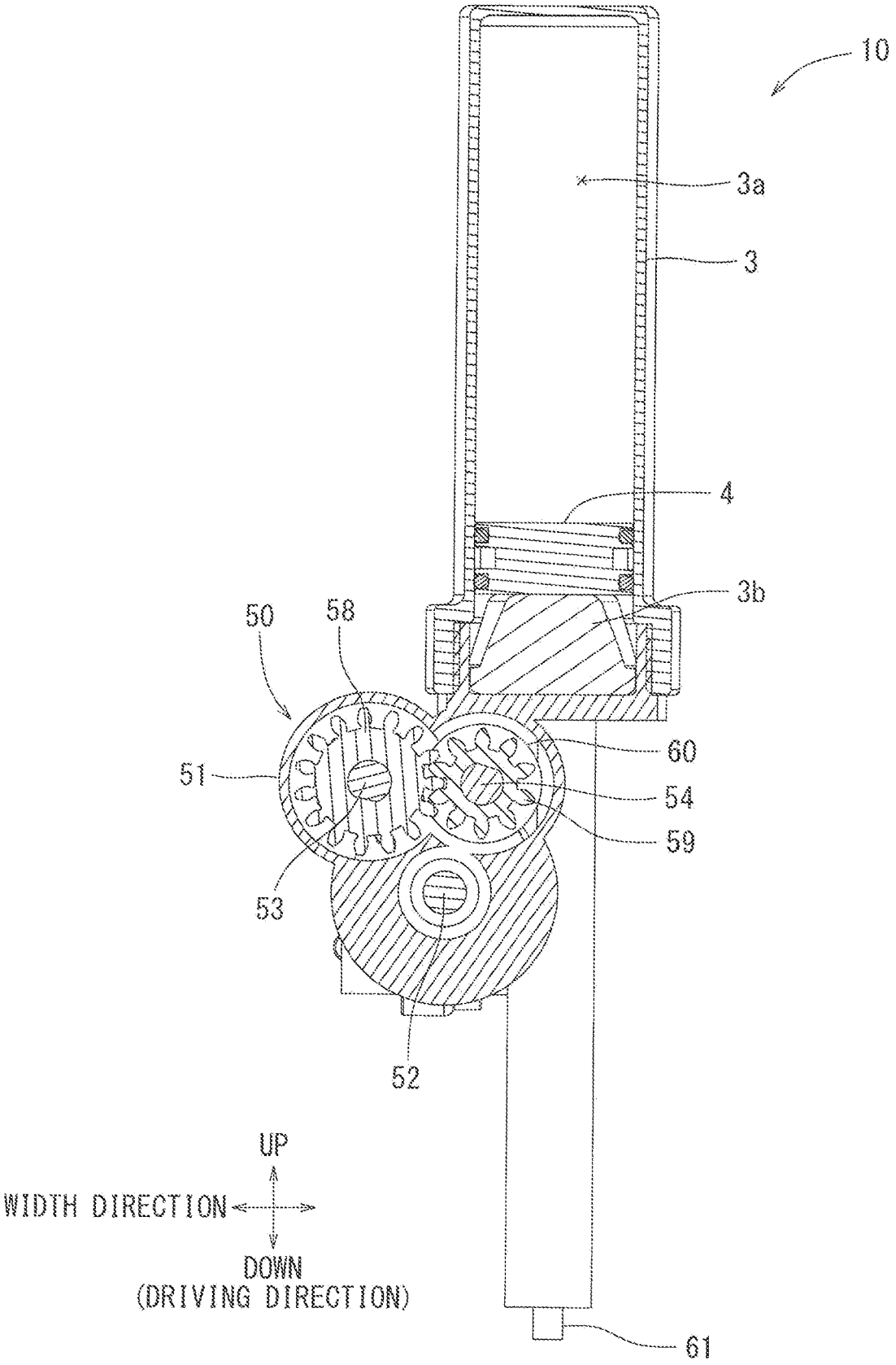
FIG. 14 is a cross-sectional view taken along line XIV-XIV of FIG. 12, showing a transversal cross-sectional view of the reduction gear.

A first wheel 55 and a first interlocking gear 56 may be connected to the driving shaft 52. As shown in FIG. 13, the first interlocking gear 56 may engage a second interlocking gear 57. The second interlocking gear 57 may be connected to the first driven shaft 53. As shown in FIGS. 13 and 14, the second interlocking gear 57 and a third interlocking gear 58 may be connected to the first driven shaft 53. The third interlocking gear 58 may engage a fourth interlocking gear 59. The fourth interlocking gear 59 may be connected to the second driven shaft 54. The fourth interlocking gear 59 and the second wheel 60 may be connected to the second driven shaft 54.

As discussed above, the wheel mechanism 50 of the third embodiment may be disposed on one lateral side of the driver 61 in the width direction of the driver 61. A rotation of the driving shaft 52 may be transferred to the second driven shaft 54 with a rotation number of the second driven shaft 54 being increased via the first interlocking gear 56 to the fourth interlocking gear 59. In the third embodiment, the number of teeth of the first interlocking gear 56 to the fourth interlocking gear 59 may be configured such that a rotation speed of the second driven shaft 54 becomes three times as fast as that of the driving shaft 52. In other words, a ratio of the rotation number of the first wheel 55 to the second wheel 60 may be configured to be one to three in the third embodiment.

Furthermore, since the four interlocking gears, i.e., the first interlocking gear 56 to the fourth interlocking gear 59, may be interposed, the first wheel 55 may rotate in the same direction as the second wheel 56. In this respect, the third embodiment may differ from the first and second embodiments.

Figure 15:
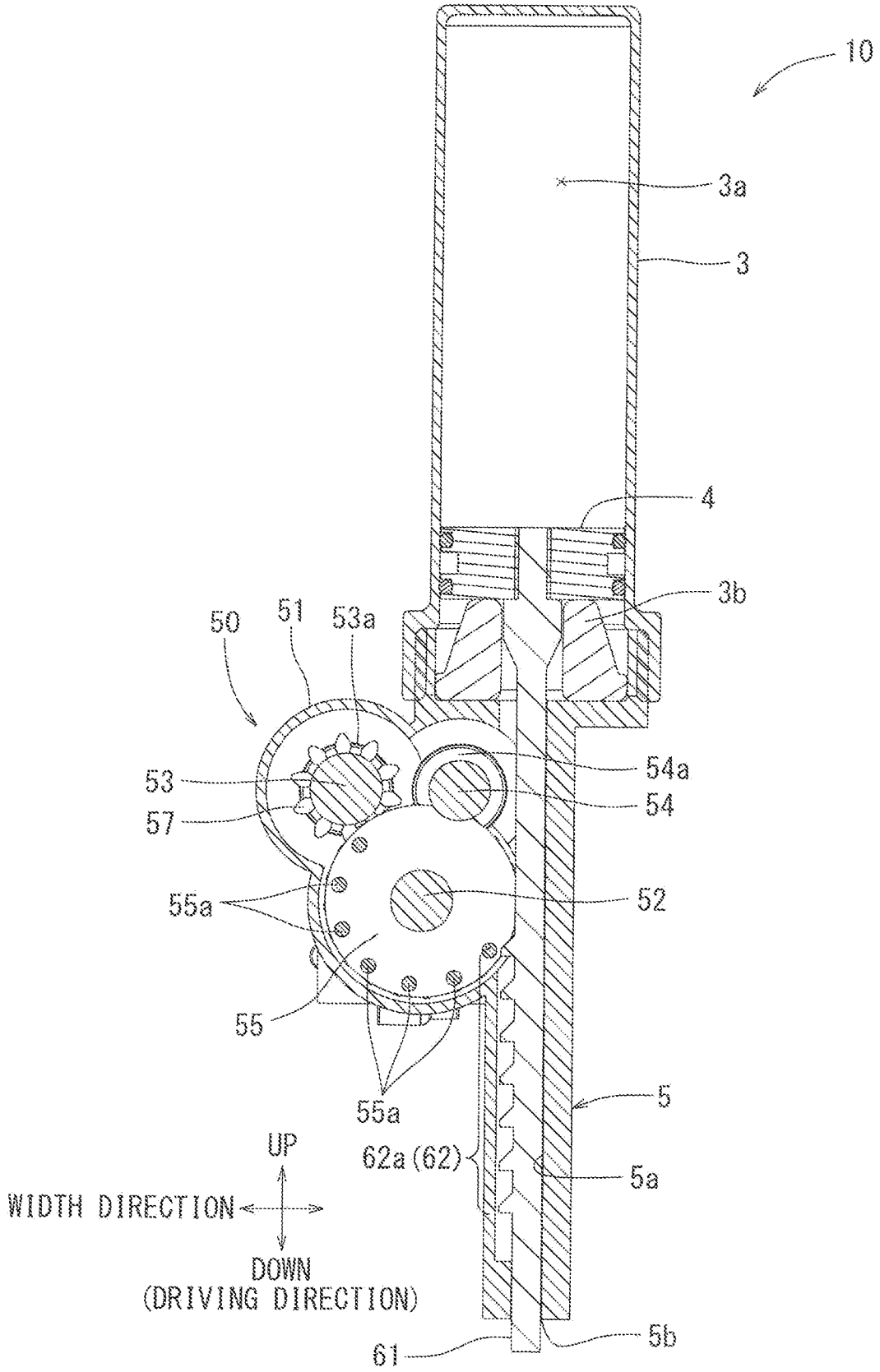
FIG. 15 is a cross-sectional view taken along line XV-XV of FIG. 12, showing a transversal cross-sectional view of the driver-returning mechanism on a side of a first wheel.
Figure 16:
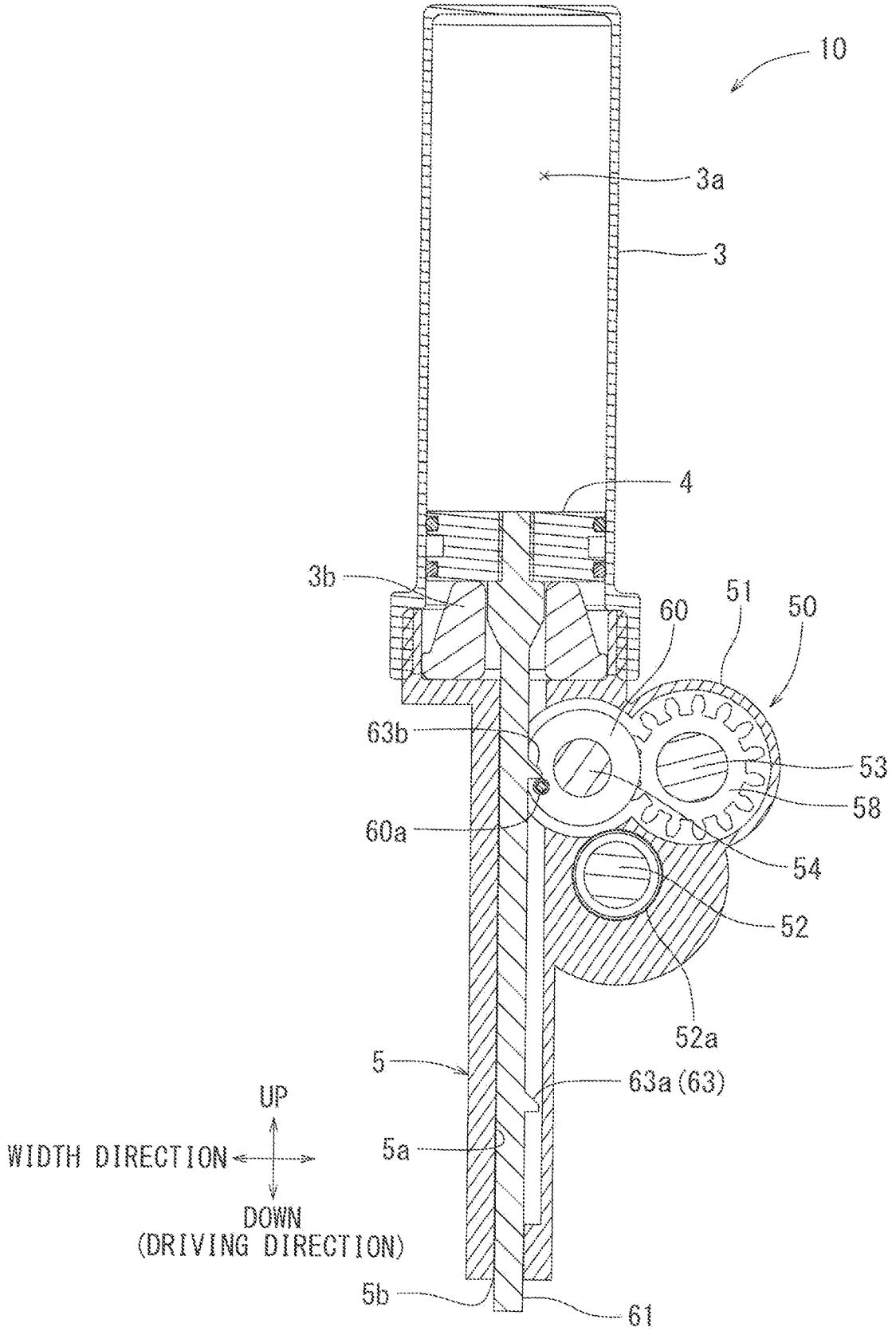
FIG. 16 is a cross-sectional view taken along line XVI-XVI of FIG. 12, showing a transversal cross-sectional view of the driver-returning mechanism on a side of a second wheel.
Figure 17:
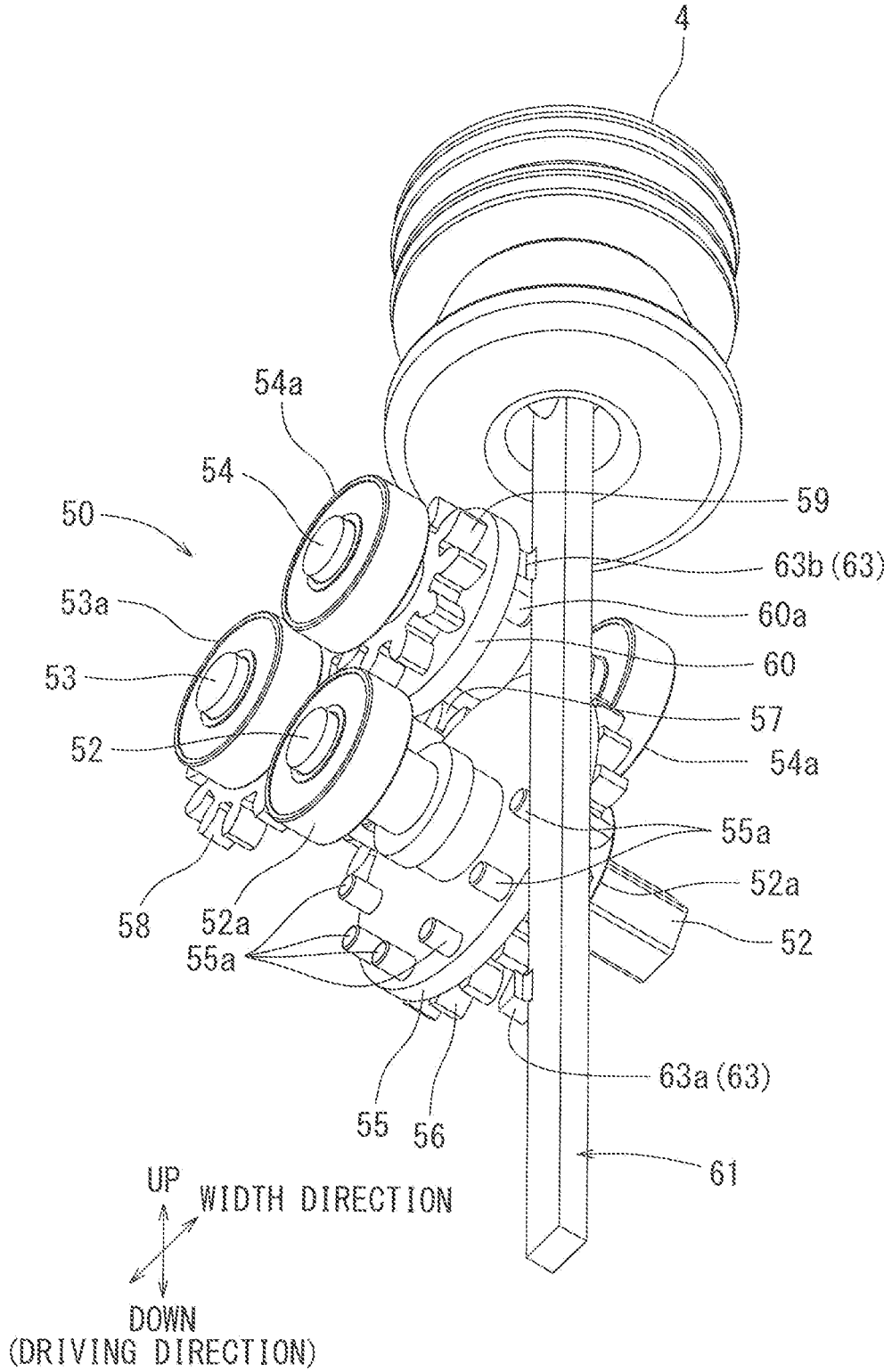
FIG. 17 is a perspective view of a driver-returning mechanism according to the third embodiment of the present disclosures.

As shown in FIG. 15, the first wheel 55 may include a plurality, for example a total of seven, first engaging portions 55*a*. The seven first engaging portions 55*a* may be disposed at equal intervals along a circumferential direction of the first wheel 55. An almost-semicircular area where the first engaging portions 55*a* are disposed may correspond to a first circumferential engaging area. A remaining circumferential area where the first engaging portions 55*a* are not disposed may correspond to a first circumferential non-engaging area. As shown in FIG. 16, the second wheel 60 may include one second engaging portion 60*a*. An area where the second engaging portion 60*a* is disposed may correspond to a second circumferential engaging area. A remaining area where the second engaging portion 60*a* is not disposed may correspond to a second circumferential non-engaging area. In this respect, the second wheel 60 of the third embodiment may be similar to the second wheel 33 in the first embodiment.

Figure 18:
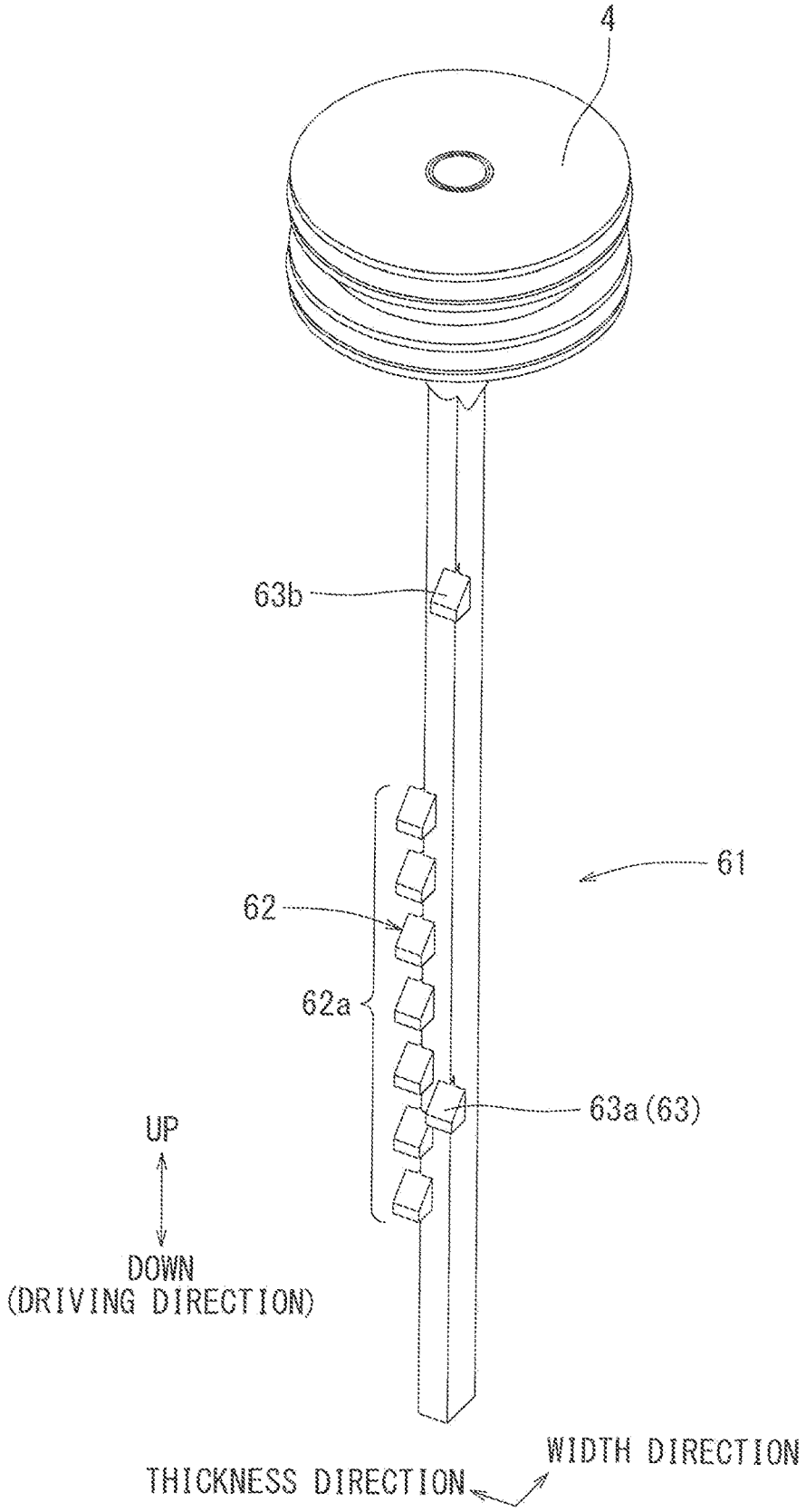
FIG. 18 is a perspective view of a driver according to the third embodiment.

As shown in FIG. 18, the driver 61 of the third embodiment may be connected to a lower surface of the driving piston 4, extending from a center thereof. The driver 61 may include a first rack 62 and a second rack 63. In the third embodiment, the first rack 62 may be disposed on the same lateral side as the second rack 63 in the width direction of the driver 61. As shown in FIG. 18, in a thickness direction of the driver 61, the first rack 62 may be disposed on one lateral side of the driver 61 and the second rack 63 may be disposed on the other side of the driver 11.

As shown in FIG. 18, the first rack 62 may be disposed along an end edge on the left side in the thickness direction. The first rack 62 may include a plurality, for example seven, engaging teeth 62*a*. The seven engaging teeth 62*a* may be disposed at equal intervals approximately on a side of the lower half of the driver 61.

As shown in FIG. 18, the second rack 63 may be disposed along an end edge on the right side in the thickness direction. The second rack 63 may include a plurality, for example two, engaging teeth. One of the engaging teeth may be an upper engaging tooth 63*b* and another may be a lower engaging tooth 63*a*. As shown in FIG. 18, the lower engaging tooth 63*a* may be disposed on a right side of an area where the first rack 62 is disposed. On the other hand, the upper engaging tooth 63*b* may be disposed above the area where the first rack 62 is disposed.

According to the wheel mechanism 50 of the third embodiment discussed above, when the electric motor 21 is activated to rotate the driving shaft 52, the first wheel 55 may rotate in the same direction as the second wheel 60. A ratio of the rotation speed of the first wheel 55 to the second wheel 60 may be one to three. As shown in FIG. 16, after the driving piston 4 reaches the moving lower end to complete a driving operation, the second engaging portion 60*a* of the second wheel 60 may engage the upper engaging tooth 63*b* from below. From the state shown in FIG. 16, the second wheel 60 may rotate clockwise and the driver 61 may move upward. Thus, the second engaging portion 60*a* may work as a starting engaging portion by which the driver 61 moves upward. This stage may generally correspond to FIG. 7(C) of the first embodiment and to FIG. 11(H) of the second embodiment.

When the driver 61 moves upward from the moving lower end, one of the first engaging portions 55*a* of the first wheel 55 may engage a corresponding engaging tooth 62*a* of the first rack 62. This stage may generally correspond to FIGS. 7(D) and 7(E) of the first embodiment and to FIGS. 11(I) and 11(J) of the second embodiment, which show a transfer of the engagement. Due to the rotation of the first wheel 55, for example in the counterclockwise direction in FIG. 15, the driver 61 may move upward further. When the first wheel 55 rotates by about one-third, the second wheel 60 may rotate approximately once. During these rotations, the driving piston 4 moves toward a standby position. When the driving piston 4 returns to its standby position, the second engaging portion 60*a* of the second wheel 60 may engage the lower engaging tooth 63*a* of the second rack 63. This stage may be a standby state, which may correspond to FIG. 7(A) of the first embodiment and to FIG. 11(F) of the second embodiment.

In the standby state, the electric motor 21 may stop and the driving piston 4 may be held in the standby position. When the switch lever 8 is pulled or when another driving cycle is otherwise started, the electric motor 21 may start to activate the driver-returning mechanism 20. Then, the driver 61 may move upward and the driving piston 4 may move toward a top dead center. The electric motor 21 may continue rotating, and when the driver 61 further moves upward, the second engaging portion 60*a* of the second wheel 60 may disengage from the lower engaging tooth 63*a* of the second rack 63. Owing to this, the driving piston 4 may move downward by the thrust power in the accumulation chamber 3*a* to perform a driving operation.

According to the wheel mechanism 50 of the third embodiment discussed above, similar to the first embodiment and the second embodiment, by primarily applying a large load and/or friction force to the second engaging portion 60*a* of the second wheel 60 when the engagement starts and releases, a load applied to each of the first engaging portions 55*a* of the first wheel 55 may be reduced. Thus, by providing the second engaging portion 60*a* of the second wheel 60 with the necessary strength and wear resistance, a cost of production may be reduced in comparison with a case where a total mechanism, including the first wheel 55, is provided with high strength and wear resistance. When a degree of wear progresses, it may be sufficient to merely replace the second engaging portion 60*a* of the second wheel 60. The original first wheel 55 may continue to be used. As a result, a cost of maintenance may be reduced.

Furthermore, according to the third embodiment discussed above, the wheel mechanism 50 may be disposed on one side of the driver 61 in the width direction of the driver 61. Thus, the wheel mechanism 50 may be made more compact in the width direction of the driving nose 5. Furthermore, the ratio of the rotation number of the first wheel 55 to the second wheel 60 may be configured to one to three (or any other integer ratio). Because of this, the second wheel 60 may be made more compact, in comparison with a case where the ratio is set to one to two. In this respect, the wheel mechanism 50 may be made more compact.

The driving tool 1 according to the first embodiment to the second embodiment may be further modified. For example, the second engaging portion 33*a*, 42*a*, 60*a* may be a columnar body with high wear resistance instead of a roller rotatably supported via a shaft.

Furthermore, a gas-spring type driving tool 1 was exemplified in the first to third embodiments, in which the gas pressure stored in an accumulation chamber 3*a* is used for the thrust power. However, the present disclosure may be applied to mechanical-spring type driving tools, in which a compression spring is used for the trust power.

What is claimed is:

1. A driving tool, comprising:

a driver provided in a housing so as to be movable in an up-down direction, thereby being configured to drive a driving member;

a driving mechanism in which driving energy is stored by movement of the driver in an upward direction;

a first rack and a second rack provided on the driver to move the driver in the upward direction;

a first wheel having a plurality of first engaging portions engageable with the first rack; and a second wheel having one second engaging portion engageable with the second rack, wherein:

the second engaging portion of the second wheel is disposed such that:

in a stage of an initial upward movement of the driver, the second engaging portion of the second wheel engages the second rack at a same time as or before the first engaging portion of the first wheel engages the first rack; and in a stage of a final upward movement of the driver, the second engaging portion of the second wheel disengages from the second rack after the first engaging portion of the first wheel disengages from the first rack.

2. The driving tool according to claim 1, wherein the first wheel is disposed on one lateral side of the driver and the second wheel is disposed on another lateral side of the driver.

3. The driving tool according to claim 1, wherein both the first wheel and the second wheel are disposed on one lateral side of the driver.

4. The driving tool according to claim 1, wherein the second engaging portion of the second wheel has a roller structure configured to rotate relative to the second rack.

5. The driving tool according to claim 1, wherein a ratio of rotation number of the second wheel to the first wheel is configured to be an integer.

6. The driving tool according to claim 1, wherein a rotation speed of the second wheel is faster than that of the first wheel.

7. The driving tool according to claim 1, wherein the second engaging portion of the second wheel has a strength higher than that of the first engaging portions of the first wheel.

8. The driving tool according to claim 1, wherein an engaging tooth of the second rack engageable with the second engaging portion of the second wheel has a strength higher than that of engaging teeth of the first rack engageable with the first engaging portions of the first wheel.

9. The driving tool according to claim 8, wherein the engaging tooth of the second rack is configured to engage the second engaging portion of the second wheel in the stage of the final upward movement of the driver.

10. A driving tool, comprising:

a driver provided in a housing so as to be movable in an up-down direction, thereby being configured to drive a driving member;

a driving mechanism in which driving energy is stored by movement of the driver in an upward direction;

a first rack and a second rack provided on the driver to move the driver in the upward direction;

a first wheel having a first engaging portion engageable with the first rack; and a second wheel having a second engaging portion engageable with the second rack, wherein:

during an upward movement of the driver, the second engaging portion of the second wheel engages the second rack at a different time than the first engaging portion of the first wheel engages the first rack.

11. The driving tool according to claim 10, wherein, after the driving member has been driven, the second engaging portion of the second wheel engages the second rack before the first engaging portion of the first wheel engages the first rack.

12. The driving tool according to claim 10, wherein, after the second engaging portion of the second wheel engages the second rack at the same time as the first engaging portion of the first wheel engages the first rack, the second engaging portion of the second wheel disengages from the second rack before the first engaging portion of the first wheel disengages from the first rack.

13. The driving tool according to claim 10, wherein, before the driving member is driven, the second engaging portion of the second wheel is engaged with the second rack after the first engaging portion of the first wheel has disengaged from the first rack.

14. The driving tool according to claim 10, wherein, before the driving member is driven, the second engaging portion of the second wheel disengages from the second rack after the first engaging portion of the first wheel disengages from the first rack.

15. The driving tool according to claim 10, wherein:

the first wheel further comprises a second first engaging portion, and after the driving member has been driven, the first engaging portion and the second first engaging portion of the first wheel both engage the first rack when the second engaging portion of the second wheel is disengaged from the second rack.

16. A driving tool, comprising:

a driver provided in a housing so as to be movable in an up-down direction, thereby being configured to drive a driving member;

a driving mechanism in which driving energy is stored by movement of the driver in an upward direction;

a first rack and a second rack provided on the driver to move the driver in the upward direction;

a first wheel having a first engaging portion engageable with the first rack; and a second wheel having a second engaging portion engageable with the second rack, wherein a lowermost engaging tooth of the second rack is positioned lower in the upward direction than a lowermost engaging tooth of the first rack.

17. The driving tool according to claim 16, wherein:

the second rack comprises a plurality of engaging teeth, the first rack comprises a plurality of engaging teeth, and an interval between the plurality of engaging teeth of the second rack is greater than an interval between the plurality of engaging teeth of the first rack.

* * * * *